United States Patent [19]

Nakamura et al.

[11] Patent Number: 5,058,401

[45] Date of Patent: Oct. 22, 1991

[54] WASHING, DEHYDRATING AND DRYING MACHINE

[75] Inventors: Fumio Nakamura, Toyokawa; Masayoshi Shimano, Okazaki; Kaoru Sakakibara, Nagoya; Masayuki Arakawa, Nagoya, all of Japan

[73] Assignee: Brother Kogyo Kabushiki Kaisha, Aichi, Japan

[21] Appl. No.: 456,167

[22] Filed: Dec. 22, 1989

[30] Foreign Application Priority Data

| | | | |
|---|---|---|---|
| Dec. 22, 1988 | [JP] | Japan | 63-325444 |
| Mar. 31, 1989 | [JP] | Japan | 1-83289 |
| Apr. 6, 1989 | [JP] | Japan | 1-89148 |
| Apr. 6, 1989 | [JP] | Japan | 1-89149 |
| Aug. 3, 1989 | [JP] | Japan | 1-201970 |

[51] Int. Cl.[5] ..... D06F 23/00

[52] U.S. Cl. ..... 68/19.2; 68/20; 68/25

[58] Field of Search ..... 68/18 F, 19.2, 20, 23 R, 68/25

[56] References Cited

U.S. PATENT DOCUMENTS

| | | | |
|---|---|---|---|
| 2,057,259 | 10/1936 | Wolff | 68/20 X |
| 2,114,776 | 4/1938 | Davis | 68/19.2 X |
| 2,142,995 | 1/1939 | Busi | 68/25 |
| 2,171,499 | 8/1939 | Busi | 68/25 |
| 2,283,612 | 5/1942 | Perry | 68/20 |
| 2,556,303 | 6/1951 | Traube | 68/19.2 |
| 2,559,708 | 7/1951 | Calhoun | 68/25 |
| 2,868,004 | 1/1959 | Runde | 68/19.2 X |
| 2,893,135 | 7/1959 | Smith | 68/19.2 X |
| 4,114,406 | 9/1978 | Horowitz et al. | 68/24 |
| 4,782,544 | 11/1988 | Nystuen et al. | 68/23 R |

FOREIGN PATENT DOCUMENTS

| | | | |
|---|---|---|---|
| 455418 | 2/1928 | Fed. Rep. of Germany | 68/25 |
| 1309094 | 10/1962 | France | 68/25 |
| 61-196993 | 9/1986 | Japan . | |

*Primary Examiner*—Philip R. Coe

*Attorney, Agent, or Firm*—Oliff & Berridge

[57] ABSTRACT

In the machine of this invention, a rotation-support member is provided in an outer tub for containing water so that the rotation-support member can rotate about a vertical axis. The rotation-support member supports a perforated inner tub rotatable about a horizontal axis. A heating means heats air in the inner tub. When the laundry is washed or rinsed, the laundry is loaded in the inner tub, water is supplied to the outer tub until the water reaches inside the inner tub, and the inner tub is rotated about the horizontal axis. The laundry is prevented from jumping out of the inner tub during the washing and rinsing process due to boards or net provided in the inner tub. When the washed or rinsed laundry is dehydrated, water is drained from the outer tub, the rotation-support member and the inner tub are rotated together about the vertical axis in the same direction at the same high speed. When the dehydrated laundry is dried, the inner tub is rotated about the horizontal axis, heated air is supplied to the inner tub, and the laundry is uniformly exposed to the air to dry. The humid air used for drying the laundry is dehumidified, moisture in the air is drained to the outside, and dehumidified air is recirculated in the machine. The machine of this invention shifts from one process to another without changing its attitude. Consequently, the machine is simply constructed and inexpensively manufactured.

25 Claims, 30 Drawing Sheets

WASHING, DEHYDRATING AND DRYING MACHINE

BACKGROUND OF THE INVENTION

This invention relates to a laundry machine that can wash, dehydrate and dry the laundry. During dehydrating, the machine removes water from the laundry, but leaving the laundry damp.

The following two types of such laundry machine are known.

The laundry machine of the first type comprises a water container and a perforated rotation drum. The rotation drum is supported in the water container so that the drum can rotate about a horizontal axis. After the laundry is loaded in the rotation drum and water is supplied to the water container, the rotation drum is rotated to wash and rinse the laundry. Subsequently, water is drained and the rotation drum rotates at high speed to dehydrate the laundry. Finally, warm air is supplied to the rotation drum and the rotation drum rotates to dry the laundry.

Japanese Published Unexamined Patent Application No. 61-196993 proposes the second type of the laundry machine which comprises a housing, container holder in the housing, a cylindrical water container, a perforated rotation tub, and an agitator. The container holder supports the water container so that the water container can be displaced vertically or horizontally relative to the container holder. The water container rotatably supports the rotation tub which in turn rotatably supports the agitator. To wash and rinse the laundry, the water container is arranged vertically, the laundry is loaded in the rotation tub, water is supplied to the water container, and the agitator is rotated. Subsequently, water is drained from the water container, and the rotation tub is rotated at high speed about a vertical axis to dehydrate the laundry. To dry the laundry, the water container is displaced horizontally, warm air is supplied to the rotation tub, and the rotation tub is rotated about a horizontal axis.

However, in the first type of the laundry machine, after the laundry is washed, the laundry accumulates in the bottom of the rotation drum. After the rotation drum rotates about the horizontal axis at high speed to dehydrate the laundry, the following problem results. During rotation the rotation drum loses its balance and vibrates due to the unbalanced load of the laundry, thus generating noise.

In the second type of laundry machine, the water container changes its attitude between a vertical attitude and a horizontal one. This prior-art laundry machine thus requires drive mechanism for controlling the attitude of the water container, in addition to a drive mechanism for rotating the rotation tub. This prior-art laundry machine is thus complicated in structure, large-sized, and expensive. When the dehydrating process shifts to the drying process, or when the drying process shifts to the next washing process, the water container must be displaced vertically or horizontally. Consequently, the processes do not shift to the next quickly.

SUMMARY OF THE INVENTION

One object of this invention is to provide an inexpensive, small-sized washing, dehydrating and drying machine that has a simple structure without the mechanism for controlling the attitude of tubs. In addition, washing, dehydrating, and drying processes can be shifted in a short time without changing the attitude of the tubs. The processes can be executed continuously and effectively.

Another object of the invention is to provide a washing, dehydrating, and drying machine in which by agitating the laundry during the drying process the laundry can be uniformly dried.

Another object of the invention is to provide a washing, dehydrating, and drying machine in which by supplying warm air uniformly into a drying tub the laundry can be uniformly dried.

Another object of the invention is to provide a washing, dehydrating, and drying machine in which the laundry is agitated sufficiently in the drying tub so that the laundry is prevented from gathering at the center of the rotation Another object of the invention is to provide a washing, dehydrating, and drying machine in which hot and humid air used for the drying process is dehydrated so that humid air is prevented from leaking to the outside of the machine.

Another object of the invention is to provide a washing, dehydrating, and drying machine in which bubbles resulting from the washing process can be prevented from leaking through a warm-air inlet or outlet to the outside.

These objects are achieved by a washing, dehydrating and drying machine which comprises an outer tub for containing water, a means for supplying water to and draining water from the outer tub, a rotation support member rotatable about a vertical axis in the outer tub, and a perforated inner tub containing the laundry and being supported by the rotation support member for rotating about a horizontal axis. The washing, dehydrating, and drying machine further comprises an inner-tub rotation means for rotating the inner tub, a rotation drive means for driving the inner-tub rotation means, a rotation-support member rotating means for driving the rotation-support member connectable to or disconnectable from the rotation drive means, and a heating means for raising the temperature of the air in the inner tub. When the rotation-support member rotating means disconnects from the rotation drive means, the rotation-support member rotating means allows the inner tub to rotate alone while the rotation support member is controlled to stop. When the rotation-support member rotating means connects with the rotation drive means, the rotation-support member rotating means rotates the rotation support member and the inner tub about the vertical axis together in the same direction and at the same speed.

In operation, water is supplied to the outer tub so that water reaches the inside of the inner tub and the laundry is loaded in the inner tub. The rotation-support member rotating means is then disconnected from the rotation drive means so that the inner tub rotates about the horizontal axis to wash and rinse the laundry. After the laundry is washed and rinsed, the outer tub is drained. The rotation-support member rotating means connects the rotation drive means so that the rotation support member and the inner tub rotate about the vertical axis together in the same direction and at high speed to dehydrate the laundry. After the laundry is dehydrated, the rotation-support member rotating means is disconnected from the rotation drive means so that the inner tub rotates about the horizontal axis to dry the rinsed laundry. At the same time, the heating means raises the temperature of air in the inner tub to dry the laundry.

When the laundry is dehydrated, the rotation-support member rotating means connects with the rotation drive means, controlling the rotation of the inner tub relative to the rotation support member. The inner tub is controlled not to rotate about the horizontal axis and to rotate with the rotation support member. Specifically, the inner tub and the rotation support member rotate together about the vertical axis at high speed. Consequently, even when the laundry is distributed unevenly around the vertical axis in the inner tub, the inner tub rotates stably at high speed without vibrating. Since the inner tub thus starts high-speed stable rotation without trouble, the laundry is distributed evenly around the vertical axis of the inner tub due to the centrifugal force of the inner tub. The laundry is appropriately dehydrated.

When the washing process shifts to the dehydrating process, the outer tub, the rotation support member and the inner tub do not have to change their relative attitude.

In addition, the dehydrating process smoothly shifts to the drying process without changing the attitude of the outer tub, the rotation support member, and the inner tub.

BRIEF DESCRIPTION OF THE DRAWINGS

FIG. 1 is a side cross sectional view of a first embodiment of the invention.

FIG. 2 is a partial cross sectional view of a cushion member for supporting an outer tub.

FIG. 3 is front partial cross sectional view of the first embodiment.

FIG. 4 is a partial perspective view of a bearing of an rotation-support member for the first embodiment.

FIG. 5 is a perspective view of the inner tub excluding a lid for the first embodiment.

FIG. 6 is a partial cross sectional view of the bearing of the rotation-support member engaged with a cylindrical member of the inner tub for the first embodiment.

FIG. 7 is a partial cross-sectional view of projections in the inner tub for the first embodiment.

FIG. 8 is a cross-sectional view of the projections in the inner tub for the first embodiment.

FIG. 9 is a partial cross-sectional view of the side of the outer tub for the first embodiment.

FIG. 10 is a top view of the first embodiment showing a warm-air supply device.

FIG. 11 is a partial front view of the first embodiment showing the warm-air supply device.

FIG. 12 is a block diagram showing a control circuit.

FIG. 13 is a time chart of processes by the first embodiment.

FIG. 14 is a flowchart for detecting lids are closed.

FIG. 15 is a flowchart for setting operation time according to detected load for the first embodiment.

FIG. 16 is a flowchart for stopping the inner tub at a predetermined position.

FIG. 17 is a flowchart for correcting the abnormal rotation of the rotation-support member when the laundry is dehydrated.

FIG. 18 is a flowchart for stopping the rotation-support member at the predetermined position.

FIG. 19 is a cross-sectional side view of the machine.

FIG. 20 is a partial cross-sectional view of a board inside an inner tub.

FIG. 21 is a partial cross-sectional front view of the third embodiment during the washing, rinsing and dehydrating processes.

FIG. 22 is a partial cross-sectional side view of FIG. 21.

FIG. 23 is a partial cross-sectional side view of the machine during the drying process.

FIG. 24 is a partial cross-sectional plan view of FIG. 23.

FIG. 25 is a partial cross-sectional view of a structure for exhausting warm air from the inner tub.

FIG. 26 is a perspective view of a fan for dehumidifying the warm air.

FIGS. 27A through 29 show a fourth embodiment of this invention.

FIG. 27A shows the drying operation of an inner tub.

FIG. 28 is a block diagram showing a control circuit for the fourth embodiment.

FIG. 29 is a time chart of the fourth embodiment.

FIG. 30 shows the concentrated laundry during the drying process.

FIG. 31 shows the agitation of the laundry according to the rotation of the rotation-support member.

DETAILED DESCRIPTION OF PREFERRED EMBODIMENTS

The first embodiment of this invention is explained referring to FIGS. 1 through 18.

STRUCTURE OF A HOUSING

Figure 1:
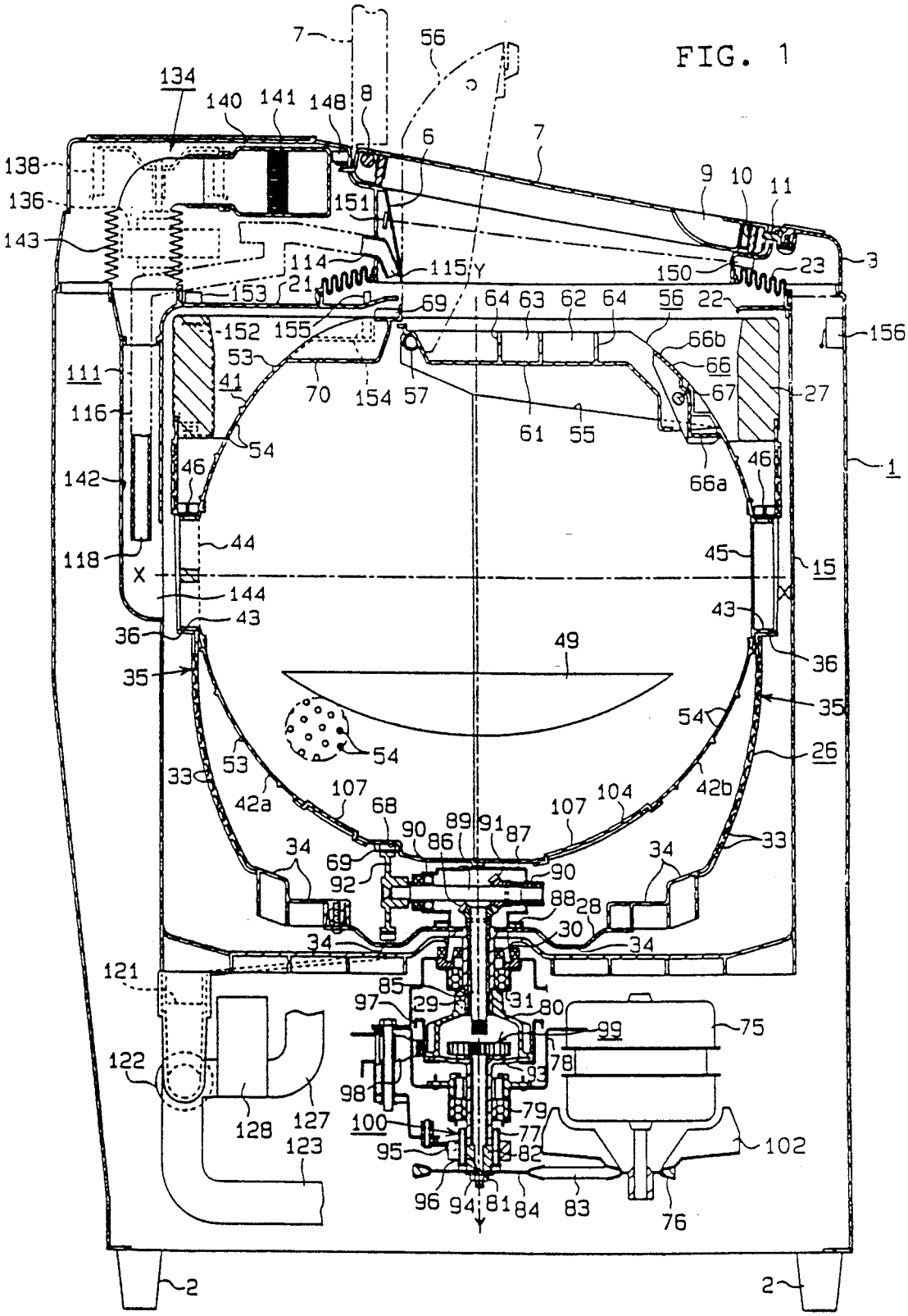
FIGS. 1 through 18 show a first embodiment of this invention.
Figure 3:
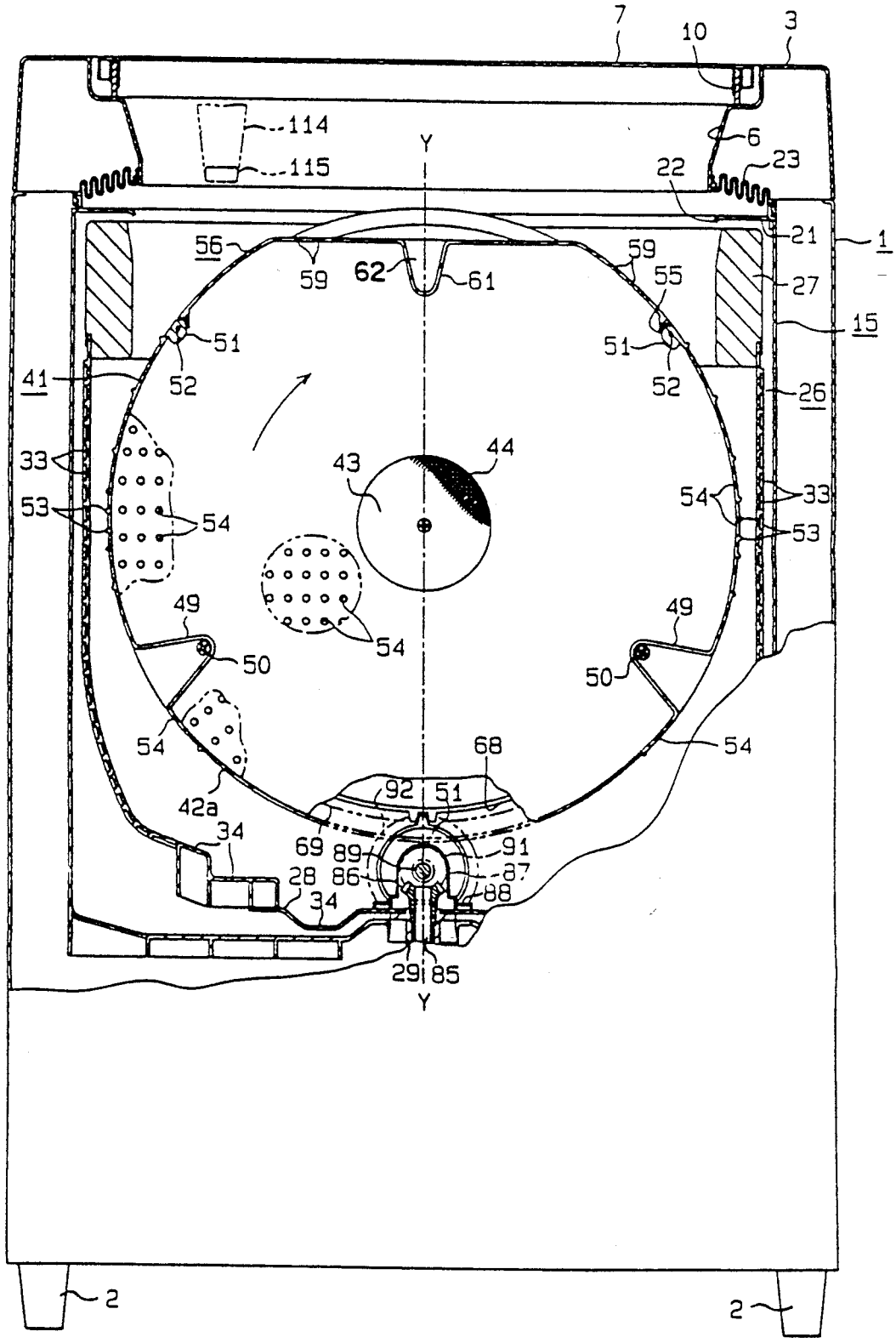
Figure 10:
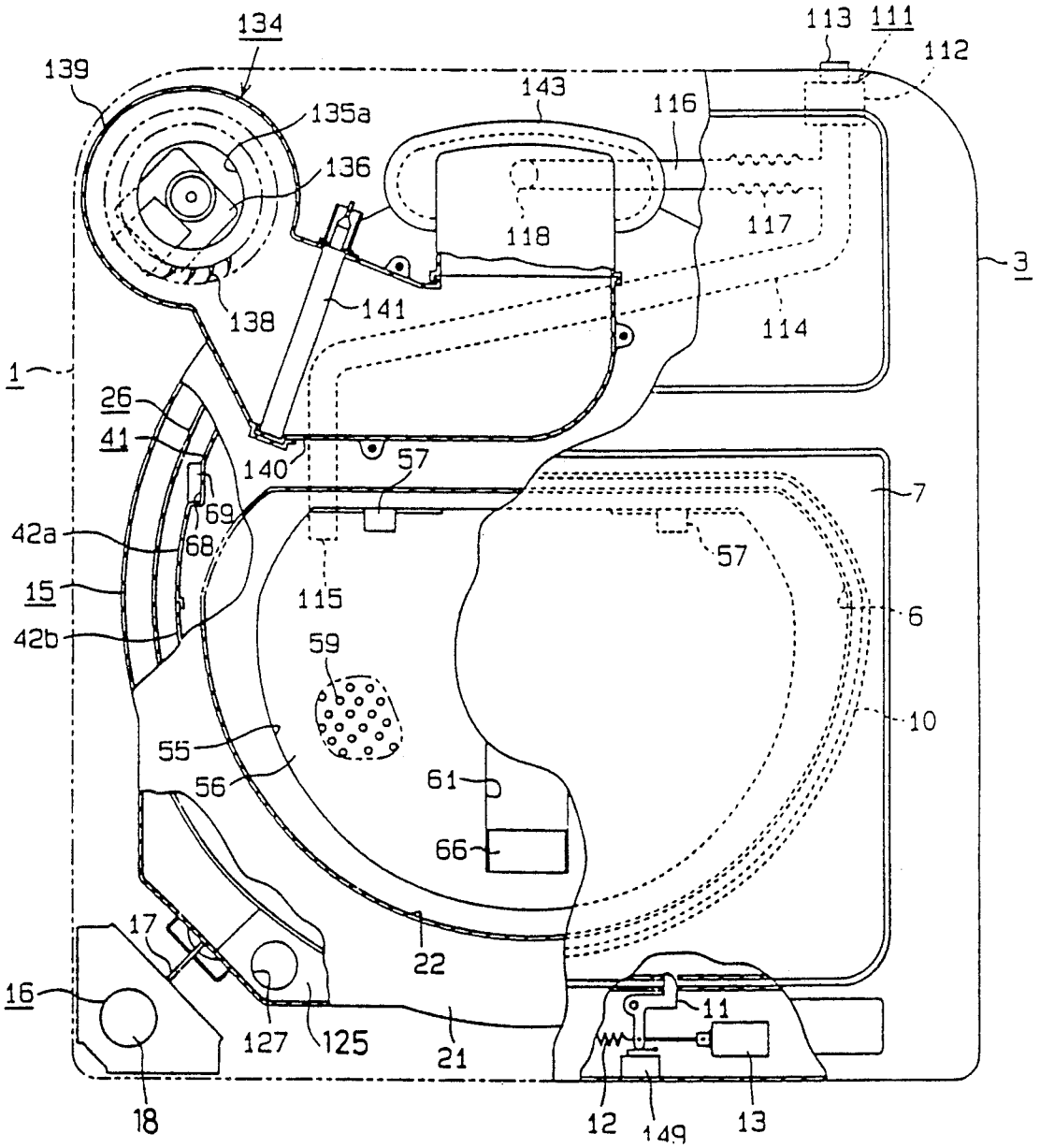

As shown in FIGS. 1, 3 and 10, a housing 1 is like a box of steel. The housing 1 has four feet 2 on its bottom and a cover 3 of synthetic resin on its top surface. An opening 6 is provided in a front top of the cover 3 through which the laundry is loaded or unloaded. A lid 7 of synthetic resin is rotatably supported on a support 8 to open or close the opening 6 in the cover 3 and has a handle 9 on the front top of the lid 7. A packing 10 of elastic rubber-like material has almost the same shape as that of the opening 6 in the cover 3.

A locking lever 11 is rotatably attached in the cover 3. A spring 12 can detach the locking member 11 from the lid 7. A solenoid 13 provided in the cover 3 energizes the locking lever 11 to engage with the lid 7 to close.

STRUCTURE OF AN OUTER TUB

Figure 2:
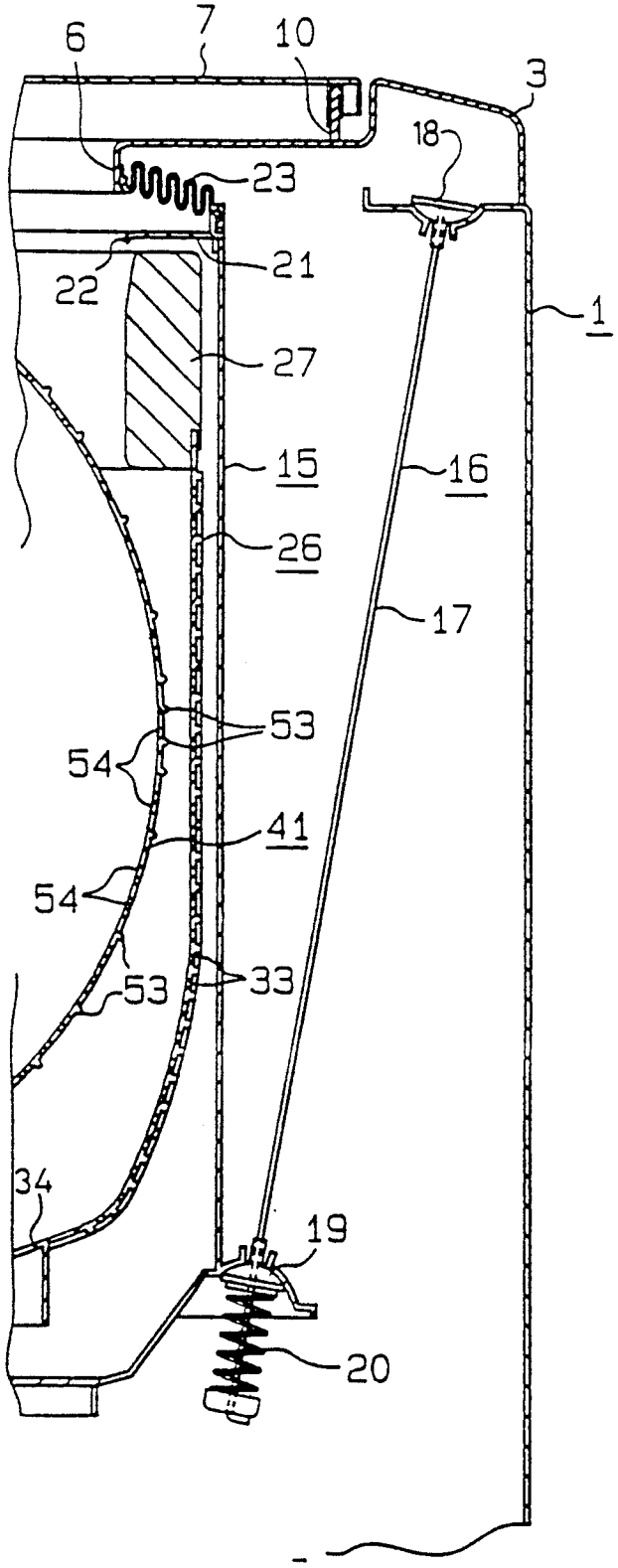

As shown in FIGS. 1 and 3, an outer tub 15 for containing water is formed in a cylinder having a bottom formed from synthetic resin. Four suspenders 16 suspend and support the outer tub 15 in the housing 1. As shown in FIG. 2, the suspenders 16 comprises rods 17, hemispherical upper engaging portions 18, hemispherical lower engaging portions 19, and springs 20.

The outer tub 15 comprises an outer-tub cover 21 and an opening 22 having a configuration similar to the opening 6 in the cover 3 of the housing 1. A bellows 23 of rubber like material interposes between the cover 3 and the outer-tub cover 21. The bellows 23 seals the openings 6 and 22 from the outside.

STRUCTURE OF A ROTARY SUPPORTER

As shown in FIGS. 1 and 3, a rotary supporter 26 is formed in a cylinder having a bottom from synthetic resin. A balancer 27 is attached at the upper end of the rotary supporter 26. A steel board 28 reinforces the center of the bottom of the rotary supporter 26. An upper hollow shaft 29 extends downward from the steel board 28 and passes through the shield 30. The upper hollow shaft 29 is supported by a bearing 31 so that the shaft 29 can rotate about a vertical axis Y—Y. Multiple pores 33 extend horizontally in the periphery of the rotary supporter 20 to drain water. Multiple drain holes 34 extend vertically in the bottom of the rotary supporter 26 and the steel board 28.

Figure 4:
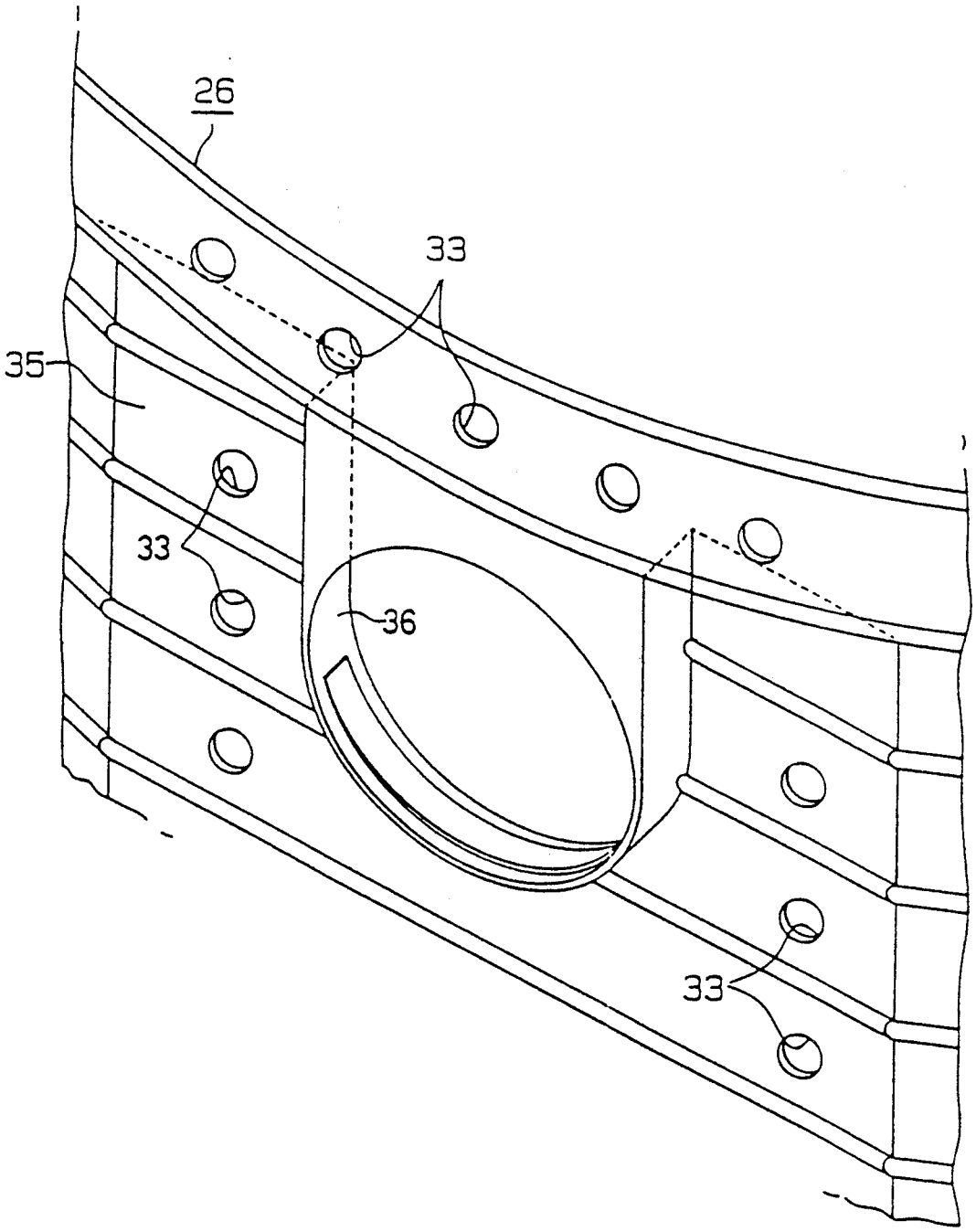
Figure 5:
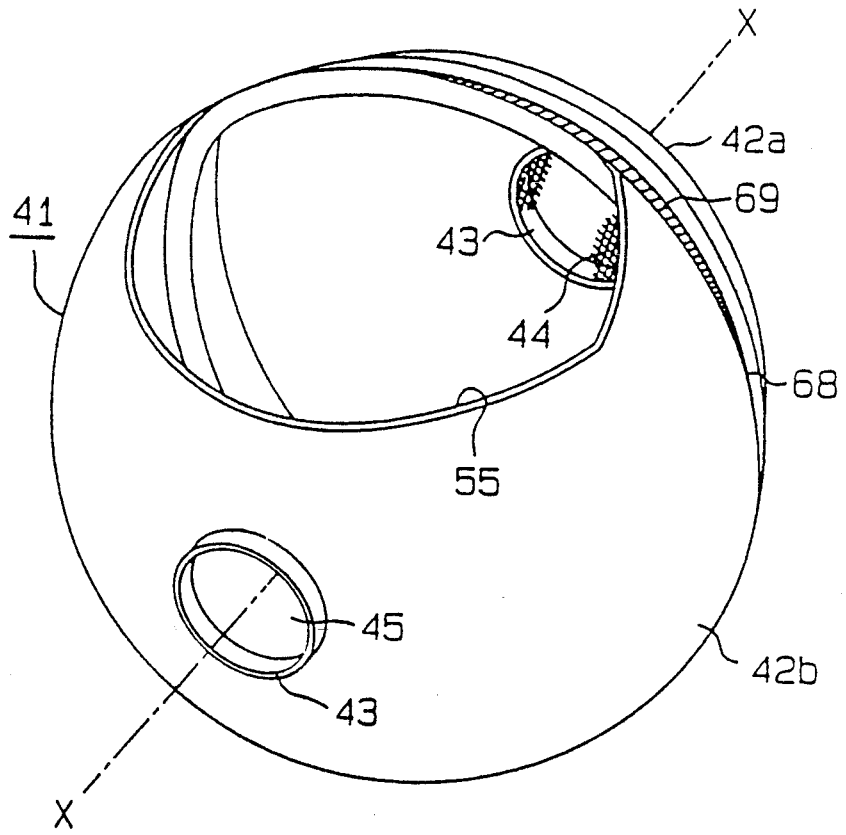
Figure 6:
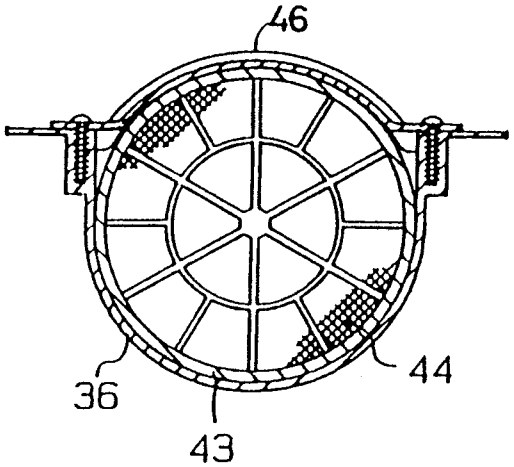

As shown in FIGS. 4 and 6, a pair of boards 35 is provided on the lower periphery of the rotary supporter 26. A pair of front and rear bearings 36 projects outward from the upper ends of the boards 35 between upper and lower halves of the rotary supporter 26 and opens into the upper half of the rotary supporter 26. The bearings 36 rotatably support cylindrical members 43 of an inner tub 41 described later.

STRUCTURE OF AN INNER TUB FOR THE FIRST EMBODIMENT

As shown in FIGS. 1, 3, 5, and 7 through 9, the spherical inner tub 41 comprises a pair of hemispherical members **42*a* and 42*b* molded from synthetic resin. A pair of short front and rear cylindrical members 43 horizontally projects outward from both sides of the inner tub 41. The rear cylindrical member 43 for introducing air to the inner tub 41 has a guard net 44 to prevent the laundry from jumping out of the inner tub 41. On the other hand, a board 45 closes the front cylindrical member 43 of the inner tub 41**.

When the inner tub 41 is inserted in the rotary supporter 26, the cylindrical members 43 engage the bearings 36 of the rotary supporter 26. As shown in FIG. 6, holders 46 are screwed onto the bearings 36 to engage the upper periphery of the cylindrical members 43 and rotatably support the cylindrical members 43. Both sides of the inner tub 41 are thus supported in the rotary supporter 26 so that the inner tub 41 rotates around a horizontal axis X—X.

Figure 7:
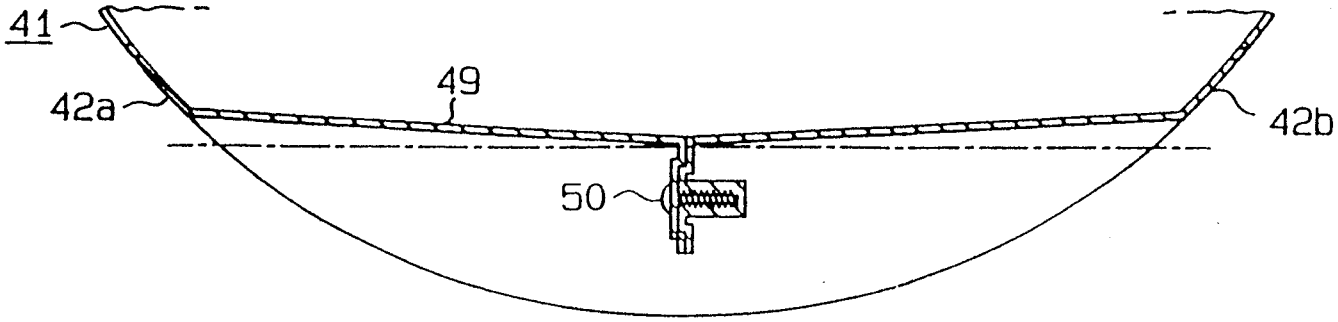
Figure 8:
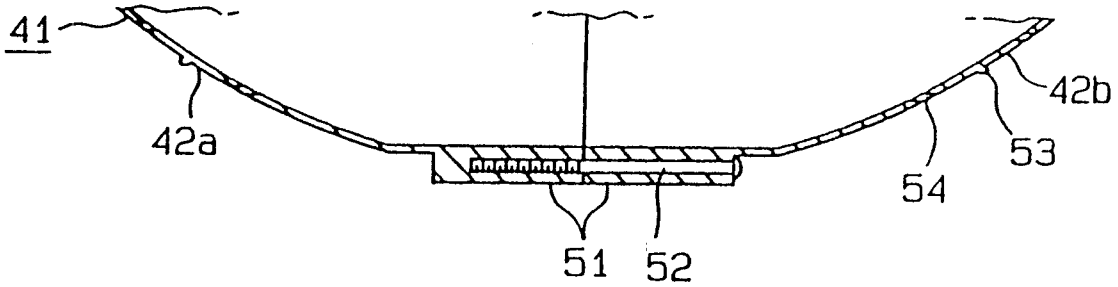

A pair of reversing members 49 for reversing the laundry, which extend almost in parallel with the rotation axis X—X of the inner tub 41, are spaced on the inner periphery of the inner tub 41. As shown in FIG. 7, the reversing members 49 are fixed using screws 50 to fasten the hemispherical members **42*a* and 42*b* of the inner tub 41. Multiple bosses 51 for reversing the laundry are provided in the inner periphery of the inner tub 41, extending in parallel with the reversing members 49. As shown in FIG. 8, the bosses 51 are fixed via screws 52 to fasten the hemispherical members 42*a* and 42*b* of the inner tub 41**.

Figure 9:
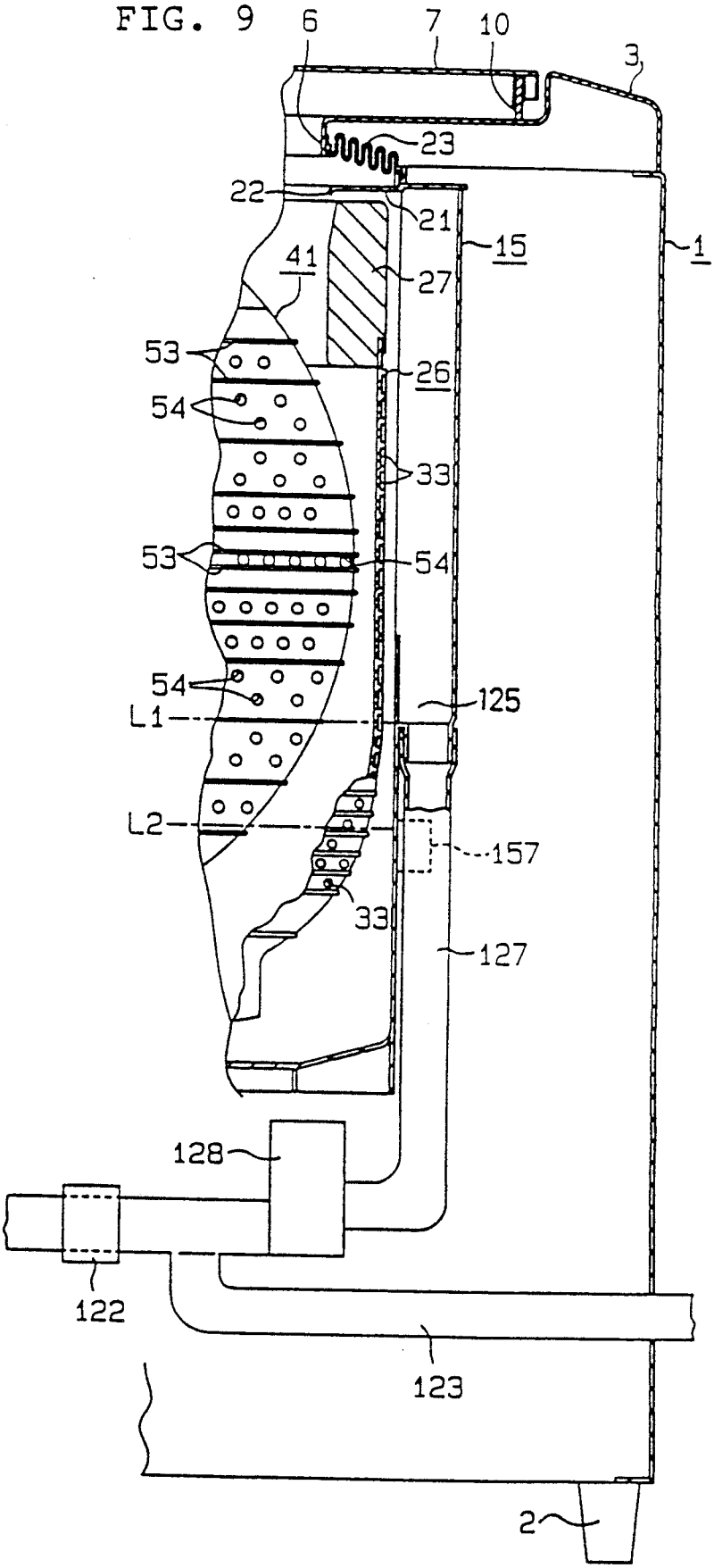

Multiple annular projections 53 are spaced at fixed intervals on the outer periphery of the inner tub 41 to reinforce the periphery of the inner tub 41. As shown in FIG. 9, the vertical distances between the projections 53 narrow near the rotation axis X—X so that the inner tub 41 can bear the concentrated load of the laundry during dehydration. Multiple pores 54 opening horizontally are formed between the projections 53 in the periphery of the inner tub 41. The opening area of the pores 54 becomes small near the rotation axis X—X of the inner tub 41. The opening area of the pores 54 far from the axis X—X expands. Since the cylindrical members 43, the reversing members 49 and the pores 54 are formed horizontally in the inner tub 41, the hemispherical members **42*a* and 42*b*** can be easily extracted from molds.

An opening 55 through which the laundry is loaded is provided in the periphery of the inner tub 41. The cross section of the opening 55 is half-moon-like shaped as that of the opening 6 in the cover 3 and the opening 22 in the outer tub 15. A lid 56 of synthetic resin can rotate on a hinge 57 so that the lid 56 can open or close the opening 55 in the same direction as the lid 7 opens or closes the opening 6. A spring (not shown) provides the lid 56 with a force so that the lid 56 opens by rotating counterclockwise in FIG. 1.

Multiple pores 59 open vertically in the lid 56. A reversing member 61 for reversing the laundry is formed in the inner surface of the lid 56. A reversing projection 70 is formed in the inner periphery of the inner tub 41. When the lid 56 is closed, the reversing member 61 and the reversing projection 70 become almost parallel with the rotation axis X—X of the inner tub 41. The reversing member 61 connected to the reversing projection 70 is opposed at a fixed distance to the pair of the reversing members 49. As shown in FIG. 3, the reversing members 49 and 61 are arranged every 120 degrees. Multiple dispensers 62 and 63 for containing soap, bleach, or other agent are defined by partitions 64 in the reversing member 61.

A locking member 66 of synthetic resin with its middle supported by a shaft 67 is rotatably attached in front of the reversing member 61. The locking member 66 has a click **66*a* on its end and an unlocking member 66*b* on its other end. The click 66*a* can engage the edge of the opening 55 in the inner tub 41. A spring (not shown) provides the locking member 66 with a force exerted counterclockwise in FIG. 1 to engage the locking member 66 with the edge of the opening 55 in the inner tub 41. The lid 56 is thus locked to close the opening 55 of the inner tub 41. The click 66*a* of the locking member 66 has an inclined surface. Consequently, when the lid 56 is closed, the click 66*a* of the locking member 66 contacts the edge of the opening 55 in the inner tub 41, and the click 66*a* once contracts against the force of the spring. After the click 66*a* passes the edge of the opening 55, the click 66*a* returns to its original form due to the spring force and engages the edge of the opening 55**.

A rim 68 is put in parallel around the outer periphery of the hemispherical member **42*a* of the inner tub 41. A non-driven gear 69 is formed on the outer periphery of the rim 68. The non-driven gear 69 forms an outermost periphery of the inner tub 41, centering on the horizontal rotation axis X—X. The upper end of the non-driven gear 69 is covered with the cover 21**.

The outer diameter of the inner tub 41 is larger than the inner diameter of the balancer 27 of the rotary supporter 26. When the inner tub 41 stands still, the lower edge of the opening 55 in the inner tub 41 is positioned above the lower edge of the balancer 27. The laundry is thus prevented from falling through the space between the lower edges of the opening 55 and the balancer 27 into the space between the inner tub 41 and the rotary supporter 26.

DRIVE MECHANISM FOR THE INNER TUB AND THE ROTARY SUPPORTER

As shown in FIG. 1, a motor 75, which drives the inner tub 41 and the rotary supporter 26 to rotate, can rotate forward and in reverse. The motor 75 is attached via brackets (not shown) under the outer tub 15.

A motor-cooling fan 102 is attached to a vertically extending motor shaft of the motor 75. A driving pulley 76 is also fixed on the vertically extending shaft of the motor 75. A lower hollow shaft 77 is rotatably supported under the upper hollow shaft 29 around the vertical axis Y—Y. A support board 78 supports a bearing 79 and the bearing 79 supports the lower hollow shaft 77. A gear housing 80 connects the upper and lower hollow shafts 29 and 77. A lower rotating shaft 81 is supported by a support metal in the lower hollow shaft 77 so that the shaft 81 rotates relative to the lower hollow shaft 77. A driven pulley 84, which is attached to the lower end of the lower rotating shaft 81, is connected via a belt 83 to the driving pulley 76. A clutch coupling 82 is also fixed to the lower end of the lower rotating shaft 81.

An upper rotating shaft 85 is supported by a support metal in the upper hollow shaft 29 so that the shaft 85 can rotate relative to the upper hollow shaft 29. A bevel gear 86 is fixed on the upper end of the upper hollow shaft 29. A gear cover 87 of synthetic resin is attached watertight through a packing 88 on the steel board 28 on the bottom of the rotary supporter 26. A non-driven rotating shaft 89 extending horizontally is supported by a bearing 90 in the gear cover 87. The non-driven rotating shaft 89 has on its end a bevel gear 91 which meshes with the bevel gear 86 in the gear cover 87, and on its other end a driven gear 92 which meshes with the non-driven gear 69. When driven by the bevel gear 86, the non-driven rotation shaft 89 axially rotates about its axis, which is parallel to horizontal axis X—X. The driven gear 92 cooperates with the non-driven gear 69 to construct a decelerating drive mechanism.

An epicycle reduction gear 93 is provided between the upper and lower rotating shafts 81 and 85 in the gear housing 80. A spring clutch 94 is provided on the outer periphery of the clutch coupling 82. When a clutch click 95 is released from a clutch housing 96, the lower rotating shaft 81 is connected with the lower hollow shaft 77 through the spring clutch 94. On the other hand, when the clutch click 95 snaps into the clutch housing 96, the lower rotating shaft 81 is disconnected from the lower hollow shaft 77. A brake drum 97 is provided on the outer periphery of the gear housing 80. When a brake body 98 contacts the brake drum 97, the rotary supporter 26 as well as the upper and lower hollow shafts 29 and 77 are stopped.

During the washing, rinsing, and drying of the laundry, the spring clutch 94 disengages and the brake body 98 works. Subsequently, the rotation of the motor 75 is transmitted through the driving pulley 76, the belt 83, the driven pulley 84, the lower rotating shaft 81, the epicycle reduction gear 93, the upper rotating shaft 85, the bevel gears 86 and 91, the non-driven rotating shaft 89, the driven gear 92, and the non-driven gear 69 to the inner tub 41. The inner tub 41 is thus rotates around the horizontal rotation axis X—X at low speed of about 30 rpm.

On the other hand, during the dehydrating of the laundry, the spring clutch 94 engages and the brake body 98 disengages. The rotation of the motor 75 is then transmitted through the driving pulley 76, the belt 83, and the driven pulley 84 to the lower rotating shaft 81. At the same time, the rotation of the clutch coupling 82 is transmitted through the spring clutch 94 to the lower hollow shaft 77. Subsequently, the rotation of the lower hollow shaft 77 is transmitted through the gear housing 80 to the upper hollow shaft 29. The rotary supporter 26 as well as the inner tub 41 rotate around the vertical rotation axis Y—Y at high speed of about 900 rpm. Since the upper rotating shaft 85 rotates with the upper hollow shaft 29, the non-driven rotating shaft 89 does not axially rotate about its axis. Instead, the entire non-driven rotating shaft 89 rotates with the rotary supporter 26 about the vertical axis Y—Y. Therefore, the inner tub 41 does not rotate about the horizontal axis X—X.

The drive mechanism including the epicycle reduction gear 93 and the non driven gear 69 composes an inner-tub rotation drive mechanism 99 for rotating the inner tub 41 when the laundry is washed, rinsed, and dried. The lower hollow shaft 77, the gear housing 80, the upper hollow shaft 29, and the spring clutch 94 compose a dehydrating drive mechanism 100 for rotating the rotary supporter 26 when the laundry is dehydrated. The drive mechanism including the clutch coupling 82, the motor 75, and the lower rotating shaft 81 composes a rotation drive means.

STRUCTURE FOR REMOVING LINT AND OTHER FOREIGN OBJECTS

Two holes 104 are located in the periphery of the inner tub 41, opposing the opening 55. When the inner tub 41 is stopped, the holes 104 are positioned below the rotation axis X—X of the inner tub 41. Lint or other foreign objects can be removed through the holes 104 from the gear cover 87 and the driven gear 92 in the bottom of the rotary supporter 26. Covers 107 for closing the holes 104 are detachably attached onto the holes 104.

STRUCTURE FOR WATER SUPPLY

As shown in FIGS. 1, 3, and 10, a water supply 111 for supplying water to the outer tub 15 comprises a water supply valve 112 in the housing 3. An end connection 113, which opens at the rear of the housing 3, can be connected via a hose or other connecting members to a faucet or other water sources.

A first water passage 114 is connected to the other end of the water supply valve 112. A first water outlet 115 provided on the end of the first water passage 114 opens above the outer periphery of the inner tub 41. A second water passage 116 branched through a flexible pipe 117 from the first water passage 114 has a second water outlet 118 on its end. The second water outlet 118, which opens in an air passage 142 of a warm-air supply device 134, supplies water through the air passage 142 and the rear cylindrical member 43 into the inner tub 41.

To supply water before washing or rinsing the laundry, the water-supply valve 112 opens and supplies water through the first and second water outlets 115 and 118 to the upper outer periphery of the inner tub 41 and into the inner tub 41. Before rinsing the laundry, water is supplied from the first water outlet 115 to the outer periphery of the inner tub 41 to flush soap bubbles from the outer periphery of the spherical inner tub 41. Water is further supplied from the second water outlet 118 through the air passage 142 into the inner tub 41, rinsing soap and bubbles out of the laundry in the inner tub 41.

STRUCTURE FOR DRAIN AND OVERFLOW WATER

As shown in FIGS. 1, 9 and 10, a drain outlet 121 is provided at the bottom of the outer tub 15. The drain outlet 121 is connected through a drain valve 122 to a drain hose 123. A solenoid 124 opens or closes the drain valve 122. The operation of the drain valve 122 interlocks with the operation of the click 95 and the brake body 98. Specifically, when the laundry is washed, rinsed and dried, the spring clutch 94 disengages from the clutch housing 96, the brake body 98 connects the brake drum 97, and the drain valve 122 closes. During the dehydrating of the laundry, when the spring clutch 94 connects the clutch housing 96 and the brake body 98 disconnects from the brake drum 97, the drain valve 122 opens.

An overflow water outlet 125 in the periphery of the outer tub 15 functions as a warm-air exhaust port. The overflow water outlet 125 is opposed to the rear cylindrical member 43 for supplying warm air in the inner tub 41. An overflow water hose 127 is between the overflow water outlet 125 and the drain hose 123. A cooling chamber 128 between the overflow water outlet 125 and the drain hose 123 cools and dehydrates hot and humid air resulting from the drying process. The overflow water outlet 125 below the rear cylindrical member 43 of the inner tub 41 discharges a larger amount of water than that of water supplied from the first and second water outlets 115 and 118. As shown in FIG. 9, when the laundry is rinsed, the outer tub 15 holds water up to a level L1 which level is below the horizontal rotation axis X—X of the inner tub 41. The level L1 is above a level L2 determined according to the amount of the laundry. To wash the laundry, water is supplied to the level L2.

STRUCTURE OF A WARM AIR SUPPLY DEVICE

Figure 11:
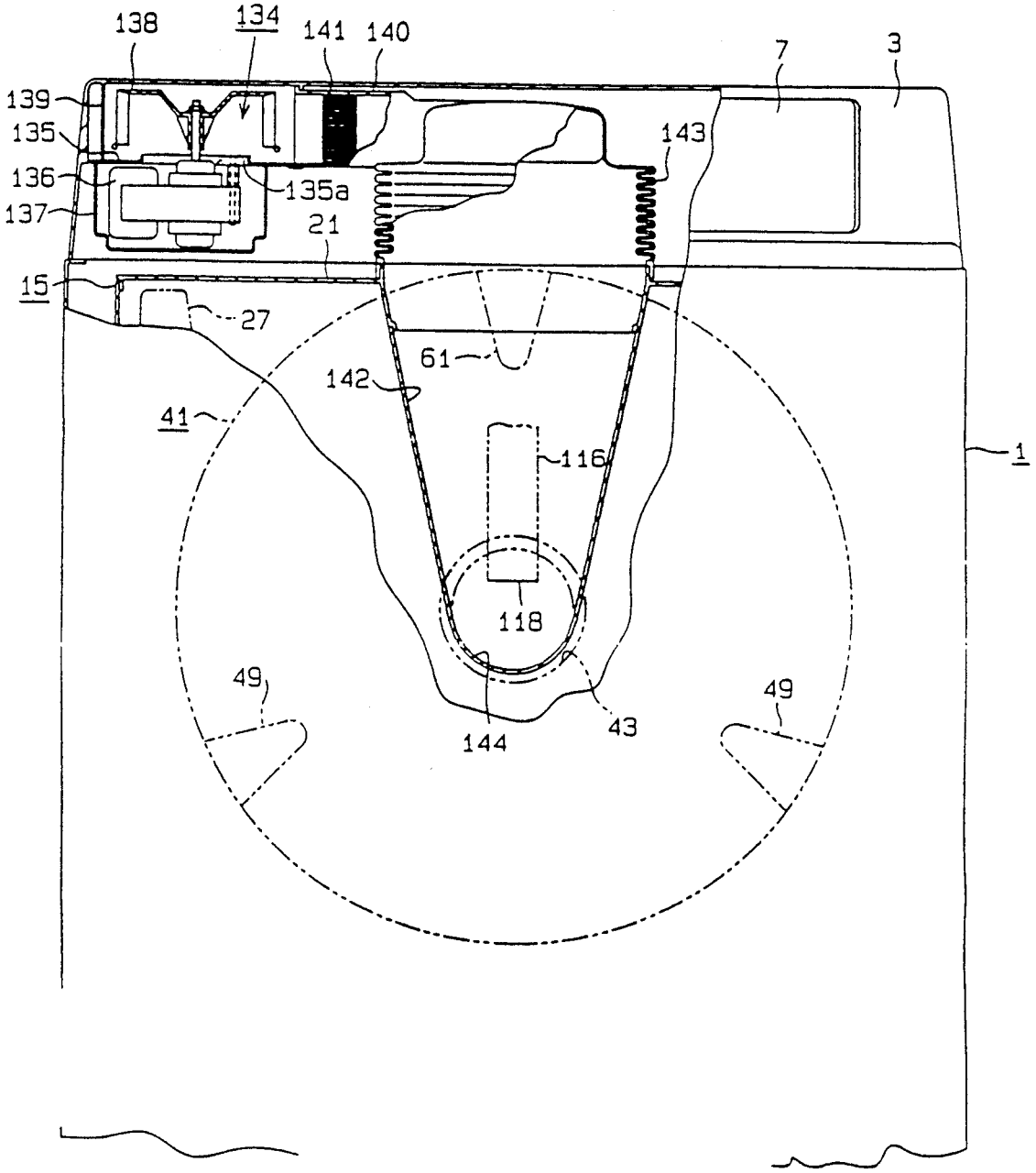

As shown in FIGS. 1, 10 and 11, the warm-air supply device 134 as a heating means is supported between the housing 1 and the cover 3 above the tubs 15, 26 and 41. When the laundry is dried, the warm-air supply device 134 supplies warm air into the inner tub 41 and raises the temperature of air in the inner tub 41.

The warm-air supply device 134 comprises a steel board 135 formed in the top inner surface of the cover 3. A fan motor 136 is attached under the steel board 135. A motor cover 137 of synthetic resin attached under the steel board 135 covers the fan motor 136. In the outer periphery of the motor cover 137, an air inlet (not shown) opens at the rear of the cover 3. A fan 138 above the steel board 135 is fixed on the shaft of the fan motor 136 and is covered by a guide rib 139 formed as one piece with the top inner surface of the cover 3. The steel board 135 has an opening 135*a* through which the shaft of the motor 136 passes.

An air guide 140 of cylindrical heat-resistant synthetic resin is connected to the guide rib 139 and is screwed onto the inner surface of the cover 3. A heater 141 is provided inside the air guide 140. The air passage 142 slopes downward at the middle of the rear of the outer tub 15 and the outer-tub cover 21. A bellows 143 connects the ends of the air guide 140 and the air passage 142. When the fan motor 136 rotates the fan 138, air outside is introduced through the motor cover 137, the opening 135*a*, and the guide rib 139 into the heater 141. The heater 141 then heats and sends out air to the air passage 142 and the air guide 140.

An air outlet 144 is connected from the lower end of the air passage 142 into the rear wall of the outer tub 15 and is opposed at a slight distance to the rear bearing 36 of the rotary supporter 26 and the rear cylindrical member 43 of the inner tub 41. Since the open area of the rear bearing 36 and the rear cylindrical member 43 is larger than that of the air outlet 144, warm air can be effectively introduced from the warm-air supply device 134, the air passage 142, the rear bearing 36 and the rear cylindrical member 43 into the inner tub 41.

STRUCTURE OF SENSORS

As shown in FIG. 1, a lid switch 148 in the cover 3 is opposite to the lid 7. When the lid 7 rotates by a fixed angle to close, the lid switch 148 issues a detection signal. A lid-locking switch 149 in the cover 3 is opposite to the locking lever 11. When the locking lever 11 locks the lid 7, the lid-locking switch 149 issues a detection signal. A lid sensor 150 consisting of element for receiving and throwing light is opposite to a reflecting board 151 at the rear of the opening 6 in the cover 3. When the locking member 66 insufficiently locks the lid 56 of the inner tub 41 and the lid 56 opens contacting the lid 7 due to the force of the spring 58, the sensor 150 issues a detection signal. When the lids 7 and 56 are closed and locked, the lid switch 148 and the lid-locking switch 149 issue detection signals, and the sensor 150 issues no detection signals. The machine of the first embodiment is thus ready to operate. When either or both of the lids 7 and 56 are opened, the lid switch 148 or the lid-locking switch 149 issues no detection signals, and the sensor 150 issues a detection signal. The machine of the first embodiment either cannot start or stops operating.

A magnet 152 on the balancer 27 of the rotary supporter 26 is a first detected body. A sensor 153 as a first detector consisting of Hall elements is positioned on the cover 21 so that the sensor 153 is aligned with the magnet 152. When the sensor 153 detects the magnet 152, the sensor 153 issues a signal indicating the detection of the position of the rotary supporter 26. After the laundry is dehydrated, a first positioned stop means comprising the magnet 152 and the sensor 153 stops the rotation of the rotary supporter 26 at a predetermined position where the rear bearing 36 of the rotary supporter 26 faces the air outlet 144 of the outer tub 15.

A magnet 154, which is provided on the middle of the outer periphery of the inner tub 41 behind the lid 56, is a second detected body. A sensor 155 as a second detector consisting of Hall elements is positioned on the cover 21 so that the sensor 155 is aligned with the magnet 154. When the sensor 155 detects the magnet 154, the sensor 155 issues a signal indicating the detection of the position of the inner tub 41. After the laundry is washed, rinsed, dehydrated, or dried, a second positioned stop means comprising the magnet 154 and the sensor 155 stops the inner tub 41 at a predetermined position where the lid 56 of the inner tub 41 is aligned with the opening 22 in the cover 21.

An excess-vibration detecting switch 156, which is provided opposite to the upper outer periphery of the outer tub 15 in the housing 1, detects abnormal vibration of the outer tub 15. During the dehydrating of the laundry, when the rotary supporter 26 vibrates excessively and rotates abnormally due to the concentrated load of the laundry in the inner tub 41, and the outer tub 15 contacts the excess-vibration detecting switch 156, the excess-vibration detecting switch 156 then issues a detection signal. A water-level sensor 157 comprising a pressure switch is provided on the outer surface of the outer tub 15. The water supply 111 supplies water into the outer tub 15 before washing the laundry. When the level L2 reaches a predetermined level in the inner tub 41, the sensor 157 issues a detection signal, stopping the supply of water.

STRUCTURE OF A CONTROL CIRCUIT

Figure 12:
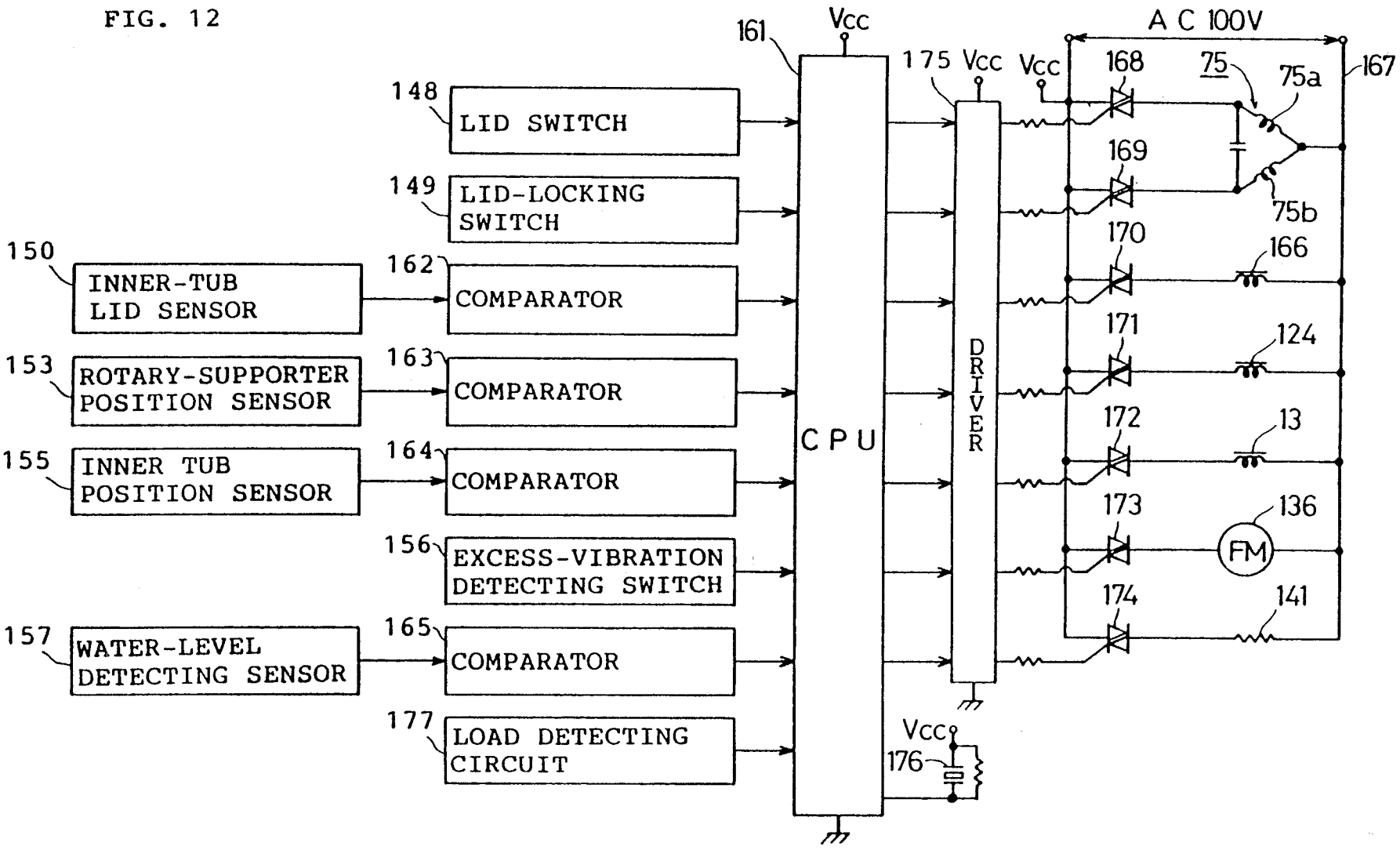

As shown in FIG. 12, a central processing unit (CPU) 161 composes a control means and determines and stores data required for controlling the operation of the machine of the first embodiment such as a water level for washing the laundry and a set cycle for washing, rinsing, dehydrating and drying the laundry. The lid switch 148, the lid-locking switch 149 and the excess-vibration detecting switch 156 send detection signals to the CPU 161. The CPU 161 also receives detection signals through comparators 162 through 165 from the sensors 150, 153, and 155, and the water-level detecting sensor 157.

On the other hand, main and auxiliary windings 75*a* and 75*b* of the motor 75, a water supply valve solenoid 166, the solenoid 124 for the drain valve 122 and the clutch 94, the solenoid 13, and the fan motor 136 and the heater 141 for the warm-air supply device 134 are juxtaposed via triode AC switches 168 through 174 to an AC power circuit 167. The CPU 161 sends an operation signal through a driver 175 and resistors to gate terminals of the triode AC switches 168 through 174.

A piezoelectric buzzer 176 connected to the output side of the CPU 161 makes a buzzing sound driven by the CPU 161 when a cycle of washing through drying processes ends or when trouble occurs such as the opening of the lid 56.

A load-detecting circuit 177 comprises a current-detecting converter provided on a circuit for supplying current to the main winding 75*a* of the motor 75. When the inner tub 41 loaded with the laundry rotates a specified number of times prior to the washing of the laundry, the load-detecting circuit 177 detects the load of the laundry according to current flowing through the main winding 75*a* of the motor 75 and sends the detected load to the CPU 161. The CPU 161 determines time period for each of the washing, rinsing, dehydrating, and drying processes according to the load detected by the load-detecting circuit 177.

When the laundry is dehydrated, the rotary supporter 26 may vibrate excessively and rotate abnormally due to the unbalanced load of laundry in the inner tub 41. When the excess-vibration detecting switch 156 detects the abnormal rotation of the rotary supporter 26, the dehydrating drive mechanism 100 disengages, stopping the rotation of the rotary supporter 26. Subsequently, the inner-tub rotation drive mechanism 99 rotates the inner tub 41 forward and in reverse a specified number of times. The eccentric load of the laundry in the inner tub 41 is thus corrected.

OPERATION OF THE FIRST EMBODIMENT

Figure 13:
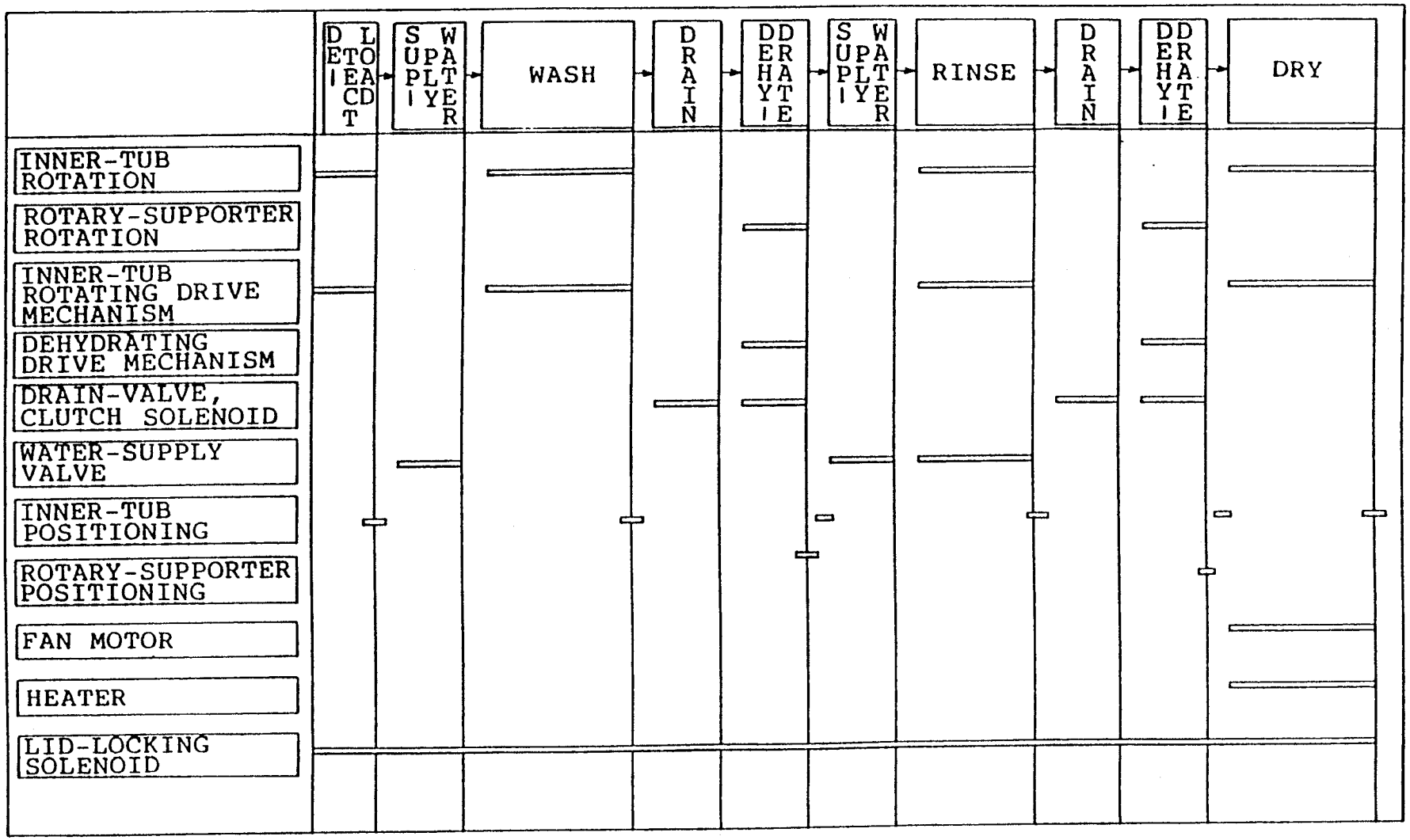

The above-constructed washing, dehydrating and drying machine of the first embodiment operates as follows:

First, the lids 7 and 56 are opened, the laundry is loaded into the inner tub 41, the lid 56 is closed, soap, bleach, or other agent is put in the dispensers 62 and 63, the lid 7 is closed, and a starting switch (not shown) is pressed. Under the control of the CPU 161, a series of processes shown in the timechart in FIG. 13 is executed automatically. First, the inner-tub rotating drive mechanism 99 rotates the inner tub 41, the load-detecting circuit 177 detects the load of the laundry in the inner tub 41, and the time for the washing process is determined.

Subsequently, the water supply 111 supplies water, the inner-tub rotating drive mechanism 99 rotates the inner tub 41 about the horizontal axis X—X to wash the laundry, the drain valve 122 opens to drain water, and the dehydrating drive mechanism 100 rotates the inner tub 41 and the rotary supporter 26 together about the vertical axis Y—Y to dehydrate the laundry. After the laundry is dehydrated, the water supply 111 supplies water, and the inner-tub rotating drive mechanism 99 rotates the inner tub 41 about the horizontal axis X—X to rinse the laundry. After the laundry is rinsed, the drain valve 122 opens to drain water and the dehydrating drive mechanism 100 rotates the inner tub 41 and the rotary supporter 26 together about the vertical axis Y—Y to dehydrate the laundry. After dehydrating the laundry, the warm-air supply device 134 supplies warm air to the inner tub 41 and the inner-tub rotating drive mechanism 99 rotates the inner tub 41 about the horizontal axis X—X to dry the dehydrated laundry.

The washing, rinsing, dehydrating and drying processes executed by the machine of this invention are explained in detail.

The laundry is washed when the inner-tub rotating drive mechanism 99 rotates the inner tub 41 about the horizontal axis X—X. In the inner tub 41, the reversing members 49 and 61 and the bosses 51 tumble the laundry.

To dehydrate the laundry, the spring clutch 94 engages and the brake body 98 disengages. The dehydrating drive mechanism 100 is thus put into operation. The drain valve 122 opens, draining water from the outer tub 15. The rotary supporter 26, driven by the motor 75, rotates about the vertical axis Y—Y to dehydrate the laundry. Since the spring clutch 94 composing the dehydrating drive mechanism 100 engages, the upper rotating shaft 85 rotates together with the upper hollow shaft 29. When the inner-tub rotating drive mechanism 99 is driven, the dehydrating drive mechanism 100 engages the lower hollow shaft 77. Consequently, the inner-tub 41 is prevented from rotating about the horizontal axis X—X. The inner-tub 41 rotates together with the rotary supporter 26 in the same direction about the vertical axis Y—Y at the same speed.

When the laundry is rinsed, in the same way as the washing process, the inner tub 41 is rotated around the horizontal axis X—X. At the same time, water is supplied through the first and second water outlets 115 and 118 to the inner tub 41. While water is continuously supplied, water used for rinsing the laundry is discharged from the overflow water outlet 125, thus keeping the water level in the outer tub 15 the same. When water is discharged from the overflow water outlet 125 to the outside, bubbles are also flushed away through the overflow water outlet 125.

When the laundry is dried, the inner tub 41 rotates about the horizontal axis X—X. In the same way as the washing process, the reversing members 49 and 61 and the bosses 51 tumble the laundry in the inner tub 41. The laundry is thus agitated in the inner tub 41. At the same time, the warm-air supply device 134 supplies warm air into the inner tub 41 to dry the laundry.

DETECTION OF CLOSED LIDS

Figure 14:
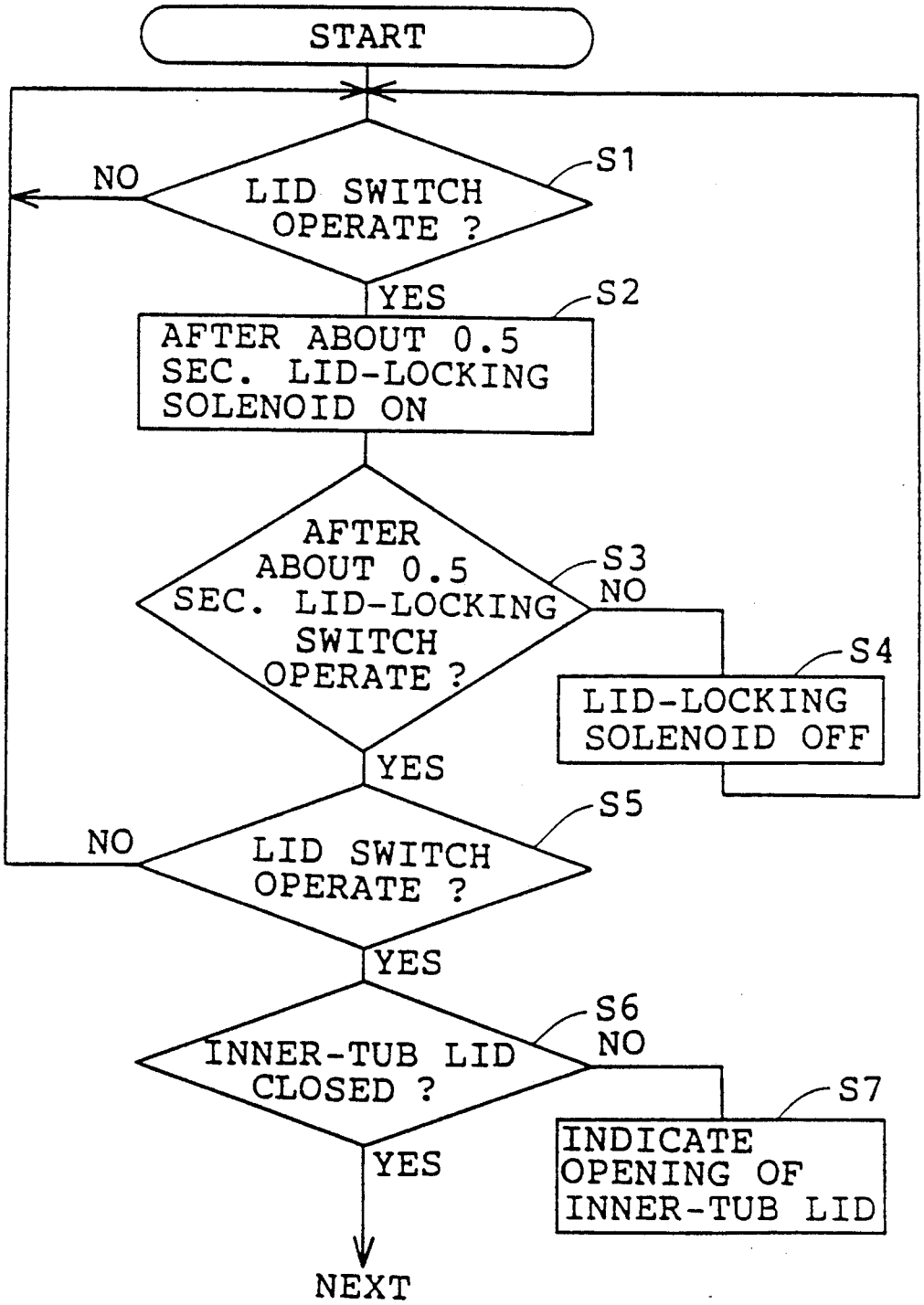

It is confirmed whether the lids 7 and 56 are closed through process shown in the flowchart of FIG. 14.

After closing the lid 56, the lid 7 is between three and five degrees above horizontal, the lid switch 148 operates at step S1. At step S2 about 0.5 seconds after the lid switch 148 detects the lid 7 is closed, the solenoid 13 turns on and the locking lever 11 can lock the lid 7. When the lid 7 is completely closed, the locking lever 11 locks the lid 7 and the lid 7 is locked until the series of the operation as aforementioned ends.

At step S3, about 0.5 seconds after the solenoid 13 is energized, the lid-locking switch 149 confirms that the lid 7 is locked. When the lid 7 is not locked, at step S4 the solenoid 13 turns off and the process goes back to step S1. When the lid 7 is locked, it is confirmed at step S5 whether the lid switch 148 operates. When the lid switch 148 does not work, the process goes back to step S1. Consequently, the lid-switch 148 and the lid-locking switch 149 both confirm that the lid 7 is closed.

After the lid switch 148 operates, at step S6 the lid sensor 150 detects whether the inner-tub lid 56 is closed. When the locking member 66 locks the lid 56, the process goes to the next. When the inner-tub lid 56 is insufficiently locked and contacts the underside of the lid 7 due to the force of the spring, at step S7 the sensor 150 detects that the lid 56 is opened and the piezoelectric buzzer 176 indicates trouble with the lid 56.

SETTING OF OPERATION TIME

Figure 15:
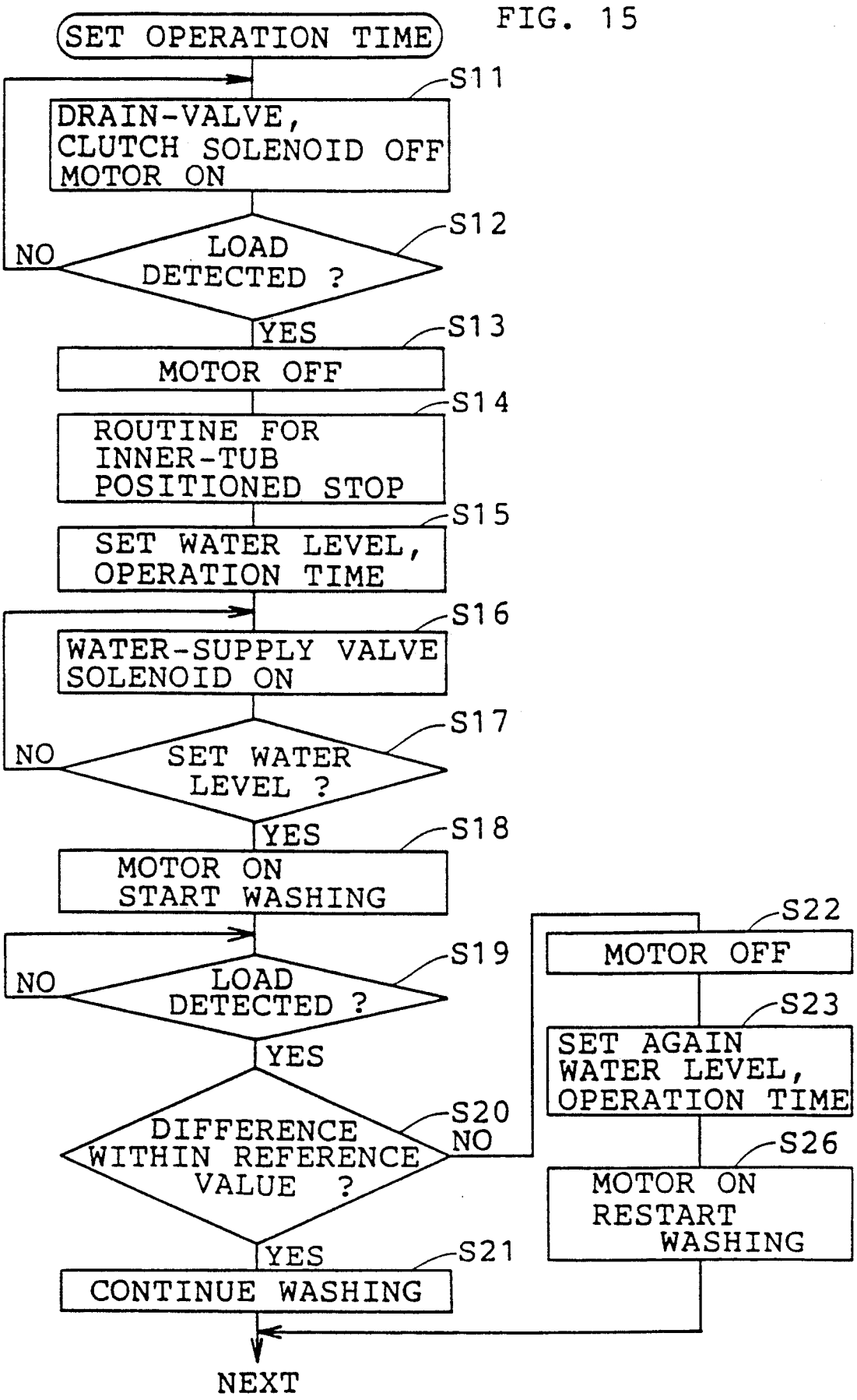

Subsequently, operation time is determined according to the detected load of the laundry through processes as shown in the flowchart of FIG. 15.

At step S11 the solenoid 124 for the drain valve 122 and the spring clutch 94 turns off, and the motor 75 rotates forward and in reverse, rotating the inner tub 41 about the horizontal axis X—X. When the inner tub 41 rotates, at step S12 the load-detecting circuit 177 detects the load of the laundry according to the electrical current loaded on the motor 75 and sends a detection signal to the CPU 161. The loads are detected when the inner tub 41 rotates for the first time and the second time, and these detected loads are averaged.

At step S13, the motor 75 is stopped. Subsequently, at step S14, the inner-tub position sensor 155 detects the magnet 154 on the inner tub 41 and the inner tub 41 stops at a predetermined position through the routine described later. At next step S15, the water level L2 and the period of time required for washing, rinsing, dehydrating or drying the laundry is determined according to the load detected by the load-detecting circuit 177. At step S16, the water-supply valve solenoid 166 turns on and the water-supply valve 112 opens to supply water through the first and second water outlets 115 and 118 to the outer tub 15. When at step S17 water in the outer tub 15 reaches the specified level L2, at step S18 the motor 75 rotates forward and the inner tub 41 rotates, thus starting washing the laundry. Subsequently, at step S19 the load-detecting circuit 177 detects the load of laundry again. After the load detected at step S19 is compared with that detected at step S12, it is determined at step S20 whether the difference between the loads is within a reference value. When the difference is within the reference value, the process goes to step S21 which continues the washing process. When the difference exceeds the reference value, step S22 stops the motor 75. Subsequently, step 23 determines again the period of time for washing, rinsing, dehydrating, or drying the laundry and the water level L2 according to the average value between the loads detected at steps S12 and S19. At step S26 the motor 75 rotates, thus restarting washing the laundry and the process goes to the next dehydrating and drying processes.

POSITIONED STOP OF THE INNER TUB

Figure 16:
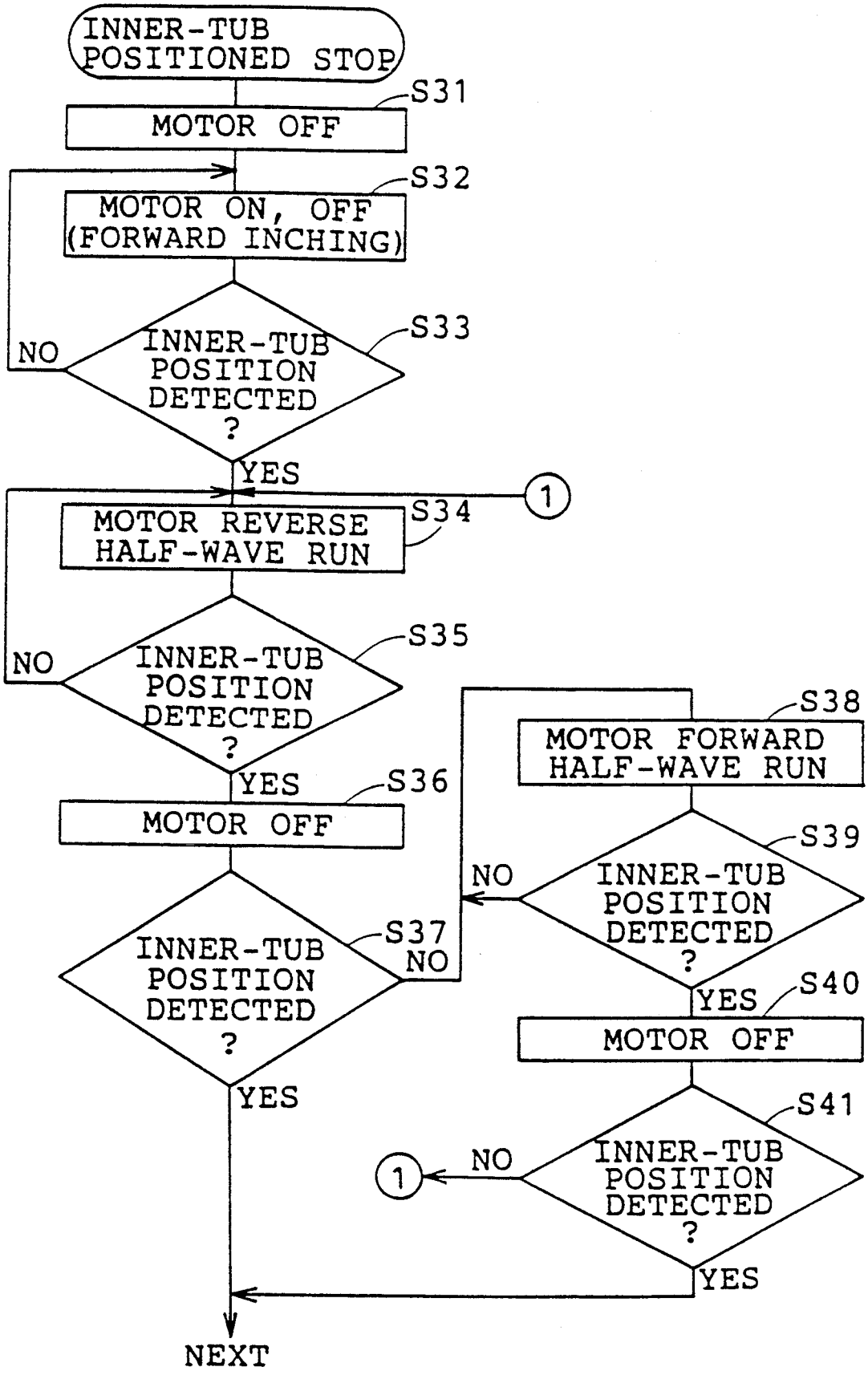

After the laundry is washed or dried, the inner tub 41 is stopped at a predetermined position through the routine shown in the flowchart of FIG. 16.

After the laundry is washed or dried, at step S31 the motor 75 is stopped. After the inner tub 41 is stopped, at step S32 the motor 75 rotates forward inch by inch, rotating the inner tub 41 at low speed. When at step S33 the sensor 155 detects the magnet 154 of the inner tub 41, at step S34 the motor 75 reverses by half-wave electric current.

Subsequently, at step S35 the inner-tub position sensor 155 detects the magnet 154 and sends a detection signal to the CPU 161. At step S36 the motor 75 stops, stopping the rotation of the inner tub 41. After the motor 75 stops, at step S37 the inner-tub position sensor 155 detects again the magnet 154 and sends a detection signal to the CPU 161. After step S37 thus detects the position of the inner tub 41, the process goes to the next.

When at step S37 the inner-tub position sensor 155 sends no detection signal to the CPU 161, the process goes to step S38 where the motor 75 rotates forward using half-wave electric current and the inner tub 41 rotates forward at low speed. Subsequently, at step S39 the inner-tub position sensor 155 sends a detection signal to the CPU 161, and at step S40 the motor 75 stops and the inner tub 41 stops rotating. After the motor 75 stops, at step S41 the inner-tub position sensor 155 detects the position of the inner tub 41 and sends a detection signal to the CPU 161. When it is thus determined that the inner tub 41 stops at the predetermined position, the process goes to the next.

CORRECTION OF ABNORMAL ROTATION OF ROTARY SUPPORTER

Figure 17:
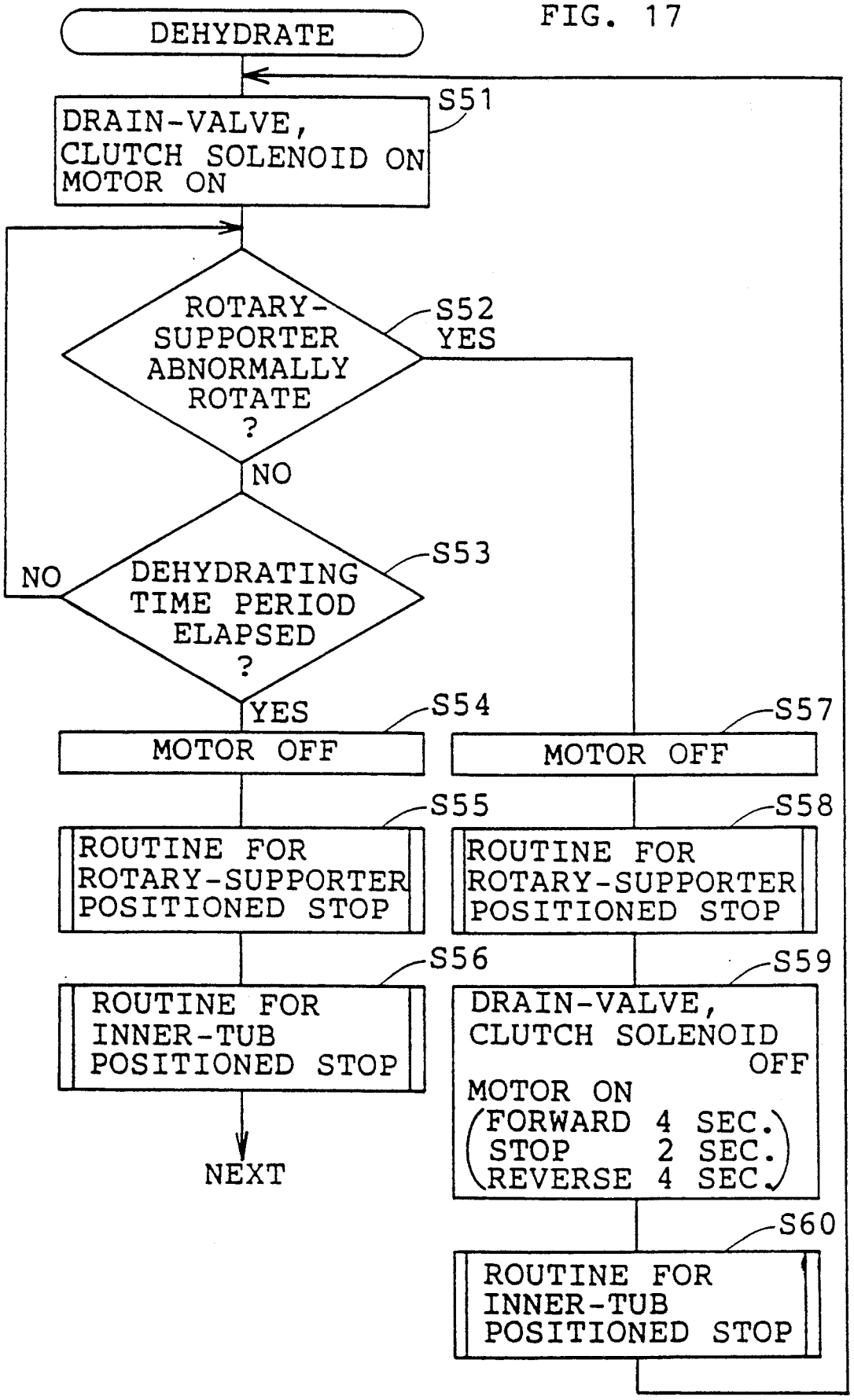

Trouble with the rotation of the rotary supporter 26 when the laundry is dehydrated is solved through the routine in the flowchart of FIG. 17.

When the laundry washed and rinsed as aforementioned is dehydrated, at step 51 the solenoid 124 turns on, the motor 75 rotates, the dehydrating drive mechanism 100 is put in operation, and the brake body 98 disengages from the brake drum 97. The rotary supporter 26 then rotates together with the inner tub 41 around the vertical axis Y—Y at high speed, thus dehydrating the laundry. At step S52 the excess-vibration detecting switch 156 detects whether rotary supporter 26 rotates abnormally. When the abnormal rotation of the rotary supporter 26 is not detected, after at step S53 dehydrating time period has elapsed, step S54 stops the motor 75. At step S55, the rotary-supporter position sensor 153 detects the magnet 152 on the balancer 27, and the rotary supporter 26 is stopped at the predetermined position according to the routine described later. At step S56 the inner tub 41 is stopped at the predetermined position according to the described routine. Subsequently, the process goes to the next. On the other hand, when the excessive-vibration detecting switch 156 detects the abnormal rotation of the rotary supporter 26, step S57 stops the motor 75 and step S58 stops the rotary supporter 26 at the predetermined position according to the described routine. Subsequently, at step S59 the solenoid 124 turns off, the inner-tub rotating drive mechanism 99 is constructed, and the brake body 98 engages the brake drum 97, thereby restraining the rotary supporter 26 from rotating about the vertical axis Y—Y. In addition, the motor 75 rotates forward for about four seconds, stops for about two seconds and then reverses for about four seconds. The inner tub 41 then rotates forward and in reverse to balance the load of the laundry in the inner tub 41, thus eliminating the cause for the abnormal rotation of the rotary supporter 26. Subsequently, step S60 stops the inner tub 41 at the predetermined position according to the described routine. The process goes back to the step S51 for dehydrating the laundry.

ROUTINE FOR STOPPING ROTARY SUPPORTER AT THE PREDETERMINED POSITION

Figure 18:
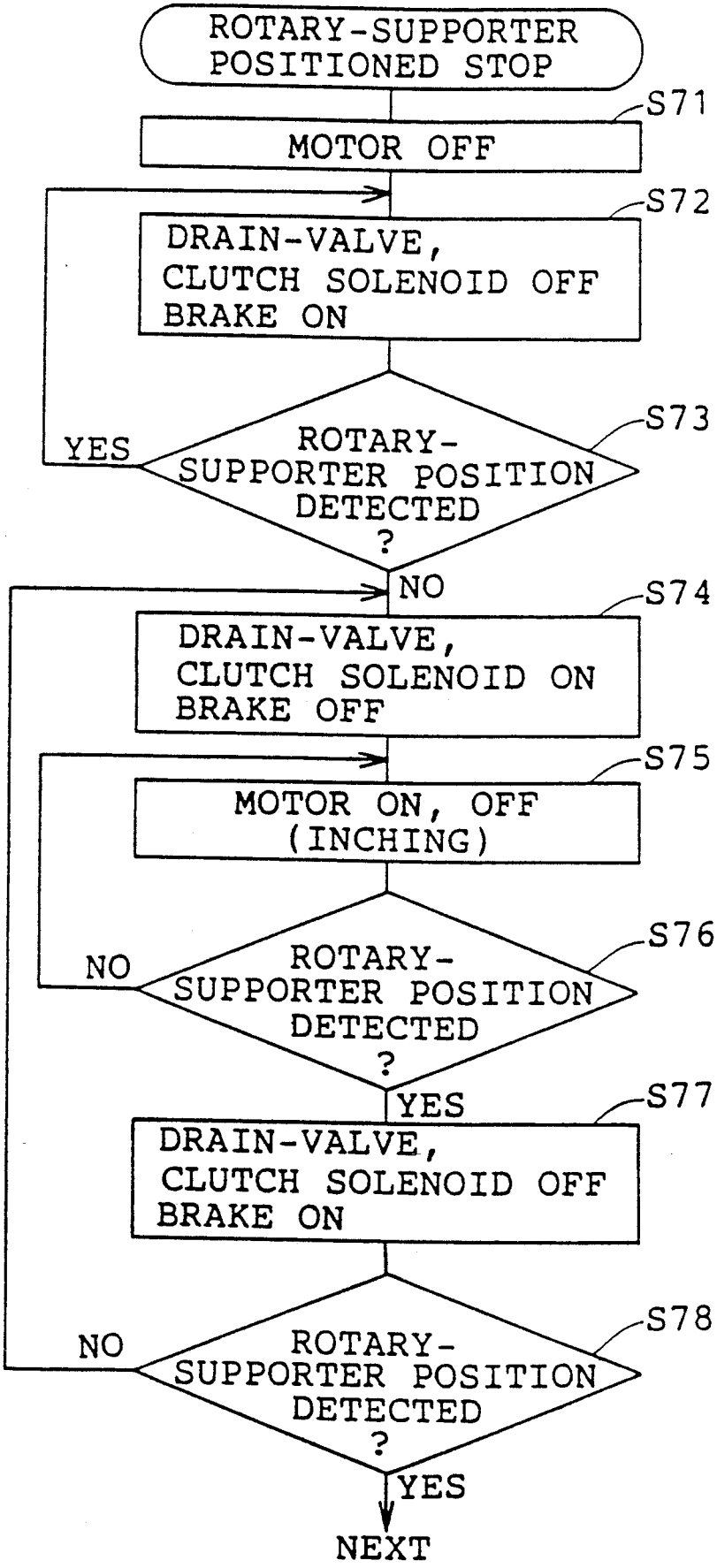

After the laundry is dehydrated as aforementioned, the rotary supporter 26 is stopped at the predetermined position according to the routine shown in the flowchart of FIG. 18.

After the laundry is dehydrated, at step S71 the motor 75 stops. At step S72 after a predetermined time the solenoid 124 turns off, and the brake body 98 engages the brake drum 97, thereby stopping the rotation of the rotary supporter 26. When at step S73 after a predetermined time period the rotary-supporter position sensor 153 issues no detection signal, it is determined that the rotary supporter 26 stops. Subsequently, at step S74, the solenoid 124 turns on and the brake body 98 disengages from the brake drum 97. At step S75, the motor 75 inches forward and the rotary supporter 26 rotates at low speed. When at step S76 the rotary-supporter position sensor 153 issues a detection signal, at step S77 the solenoid 124 turns off and the brake body 98 engages the brake drum 97, thereby stopping the rotation of the rotary supporter 26. When the rotary supporter 26 is stopped, at step S78 the rotary-supporter position sensor 153 sends a detection signal to the CPU 161. When the rotary supporter 26 is stopped at the predetermined position, the process goes to the next routine. When the rotary supporter 26 deviates from the predetermined position, the process goes back to step S74, repeating the routine for stopping the rotary supporter 26 at the predetermined position.

The processes of the machine of the first embodiment produce the following effects.

WASHING PROCESS

To wash the laundry, the inner tub 41 rotates about the horizontal axis X—X. In the inner tub 41, the reversing members 49 and 61 and the bosses 51 tumble the laundry. The machine of this invention minimizes the amount of water used for washing the laundry and the entanglement of the laundry.

DEHYDRATING PROCESS

When the laundry is dehydrated, the inner tub 41 containing the laundry and the rotary supporter 26 rotate altogether about the vertical axis Y—Y at high speed without changing their attitudes. The inner-tub 41 is restrained from rotating about the horizontal axis X—X, and rotates together with the rotary supporter 26 in the same direction about the vertical axis Y—Y at the same speed. When the inner tub 41 rotates about the vertical axis Y—Y, centrifugal force is generated. Due to the centrifugal force, the laundry is dispersed in a form of a ring around the maximum inner diameter intersecting the vertical axis Y—Y in the inner-tub 41. At this time, the inner tub 41 is restrained from rotating about the horizontal axis X—X.

In the machine of the first embodiment, even when the center of gravity of the laundry is off center on the vertical axis Y—Y, the laundry is dispersed uniformly in the inner tub 41.

When the inner tub 41 containing the laundry rotates about the horizontal axis X—X and the rotary supporter 26 rotates about the vertical axis Y—Y, the load of the laundry in the inner tub 41 becomes unbalanced. The centrifugal force resulting from the rotation of the inner-tub 41 is exerted on the center of gravity of the laundry, thus unbalancing the load of the laundry and causing vibration and noise. At the time of the starting of dehydration, when the center of gravity of the laundry is off center on the vertical axis Y—Y, the inner-tub 41 rotates about the horizontal axis X—X. The inner-tub 41 rotates in the direction where the laundry is eccentric. The inner-tub 41 can repeat its rotation until the laundry reaches the horizontal plane including the horizontal axis X—X.

The load of the laundry becomes unbalanced for the following reasons.

First, when the laundry is dispersed around the vertical axis Y—Y in the inner tub 41, frictional force is generated. When the frictional force is not uniform, the unbalanced load occurs. When the laundry is dispersed due to the centrifugal force, the laundry requires the frictional force to detach from the inner surface of the inner tub 41.

Secondly, when the center of gravity of the laundry deviates from the vertical axis Y—Y, the unbalanced load occurs.

To prevent unbalance in the load from occurring, the machine of the first embodiment restrains the inner tub 41 from rotating about the horizontal axis X—X when the laundry is dehydrated. In the machine of the first embodiment, vibration and noise resulting from the dehydrating process are suppressed. The suspenders 16 absorb the vibration of the outer tub 15 caused by the dehydrating process and the high-speed rotation. The vibration of the outer tub 15 is prevented from being transmitted to the housing 1. Since the upper and lower engaging portions 18 and 19 of the suspenders 16 vibrate at their engaging portions, the vibration of the outer tub 15 is minimized. The springs 20 of the suspenders 16 also reduce the vibration of the outer tub 15.

When the inner tub 41 rotates, the moment of inertia is caused due to the mass of the rotating balancer 27. The moment of inertia reduces the unbalance in the load due to the eccentric center of gravity of the laundry in the inner tub 41. Since the inner tub 41 is supported by the bearings 43 of the rotary supporter 26, the moment of inertia is generated on the horizontal plane including the horizontal axis X—X due to the mass of the inner tub 41 when the inner tub 41 rotates. The moments of inertia caused by the balancer 27 and the inner tub 41 are exerted on the rotary supporter 26. The unbalance in the load of the laundry is thus reduced and the vibration of the outer tub 15 is suppressed.

RINSING PROCESS

When the laundry is rinsed, the inner tub 41 rotates around the horizontal axis X—X. Water is supplied through the first water outlet 115 to the outer periphery of the inner tub 41 and through the second water outlet 118 to the inside of the inner tub 41. Bubbles are effectively flushed away from the outer periphery of the inner tub 41.

DRYING PROCESS

When the laundry is dried, the inner tub 41 rotates about the horizontal axis X—X. In the inner tub 41, the laundry is agitated. At the same time, warm air is supplied to the inner tub 41. The laundry is less entangled in the machine of this embodiment during the washing, dehydrating and rinsing processes. Therefore, the laundry is uniformly exposed to warm air and effectively dried. The bellows 23 renders the inside of the outer tub 15 airtight, thus preventing hot and humid air from leaking outside the outer tub 15. The bellows 143 absorbs the vibration of the outer tub 15 during the drying process. Consequently, warm air can be supplied without problem.

POSITIONED STOP OF THE INNER TUB AND THE INNER-TUB HOLDER

When the lid 56 is aligned with the opening 22 in the cover 21, the inner tub 41 is stopped, thereby facilitating the loading and unloading of the laundry.

When the bearings 36 of the rotary supporter 26 and the cylindrical members 43 of the inner tub 41 are aligned with the air outlet 144 of the outer tub 15, the rotary supporter 26 is stopped. Consequently, the laundry is effectively dried when warm air is smoothly supplied.

Figure 19:
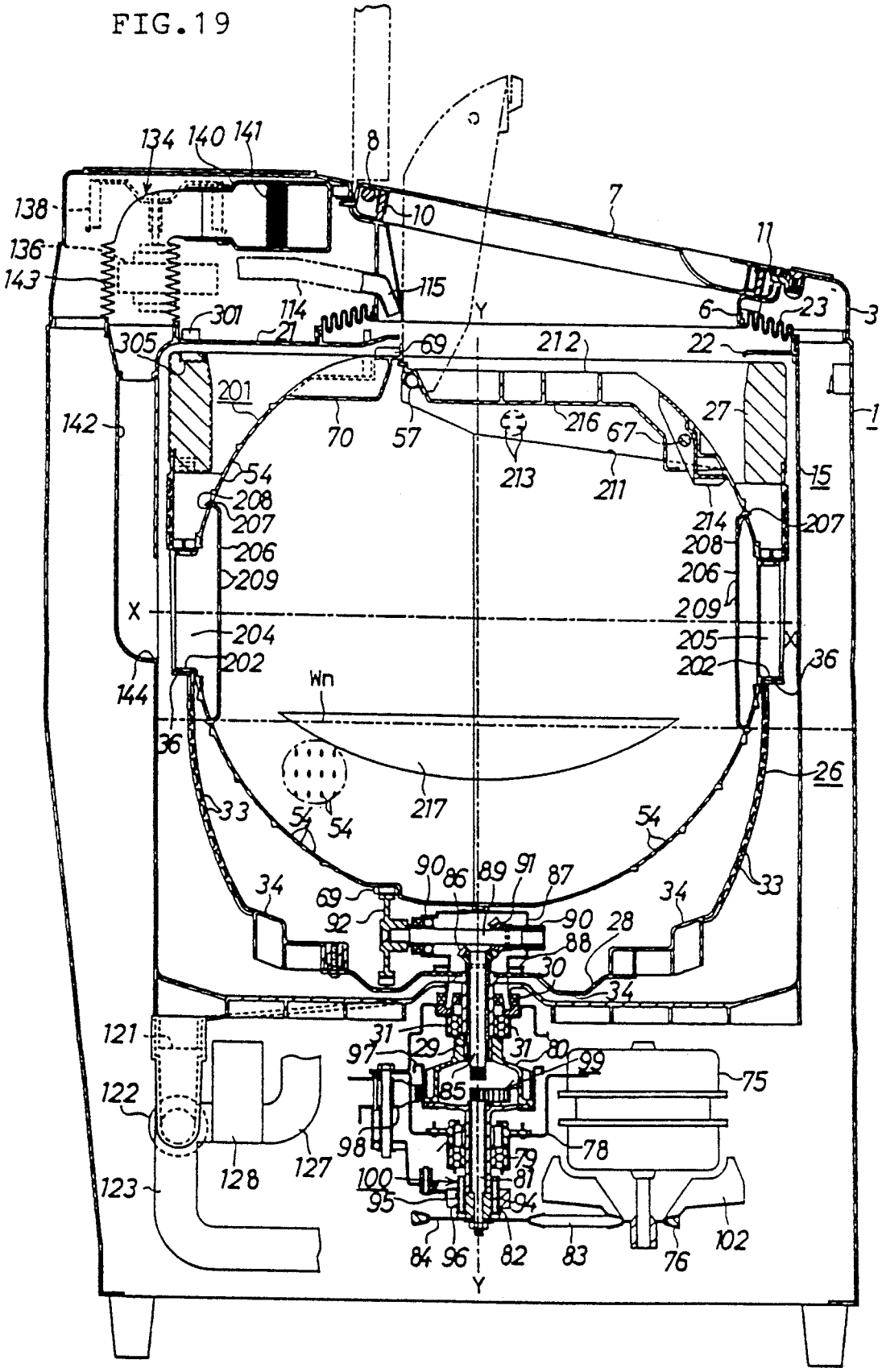
FIGS. 19 and 20 show a second embodiment of this invention.
Figure 20:
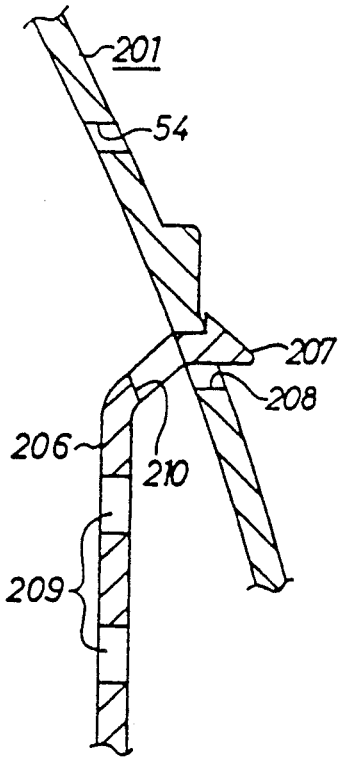
Figure 21:
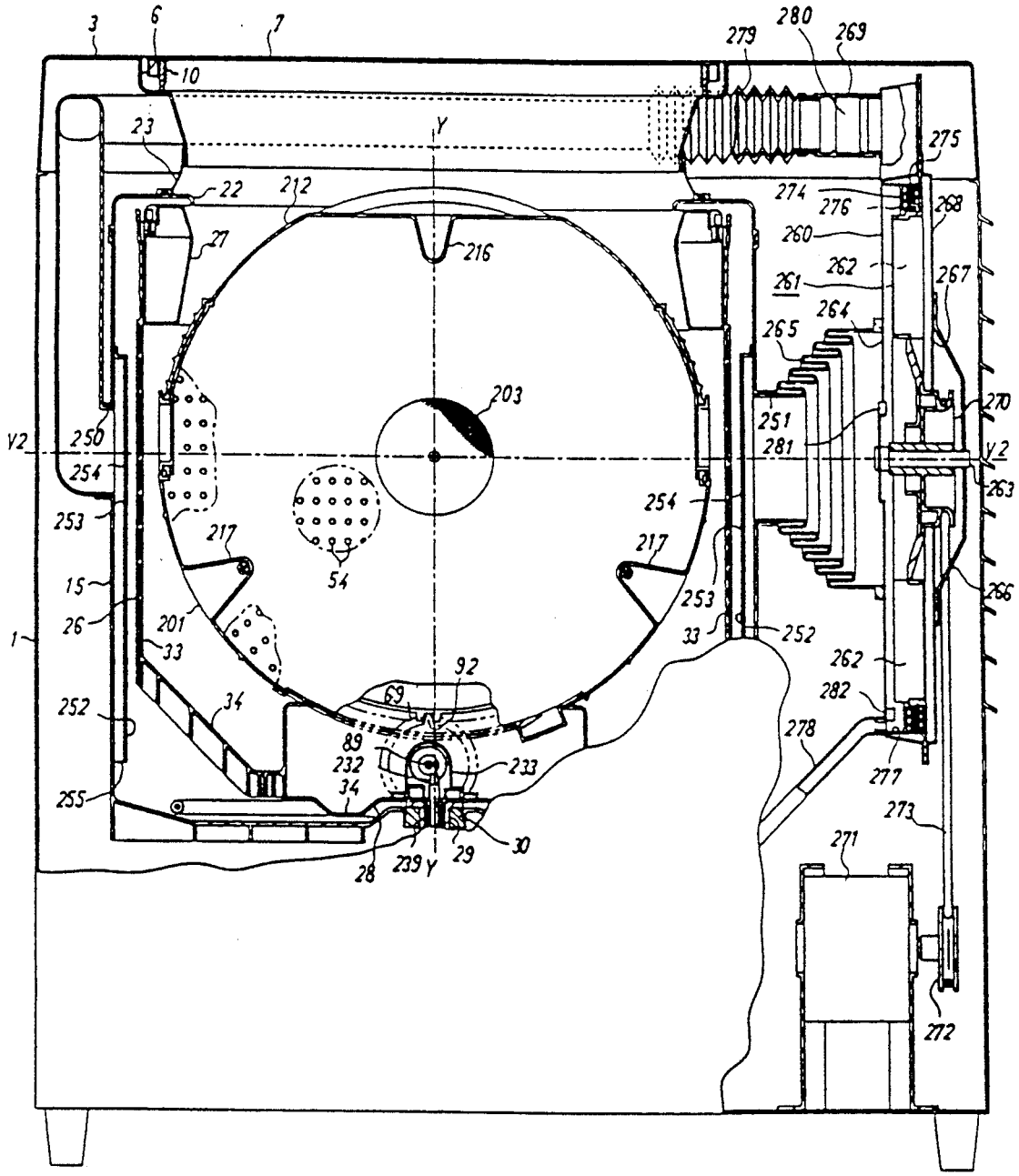
FIGS. 21 through 26 show a third embodiment of this invention.
Figure 22:
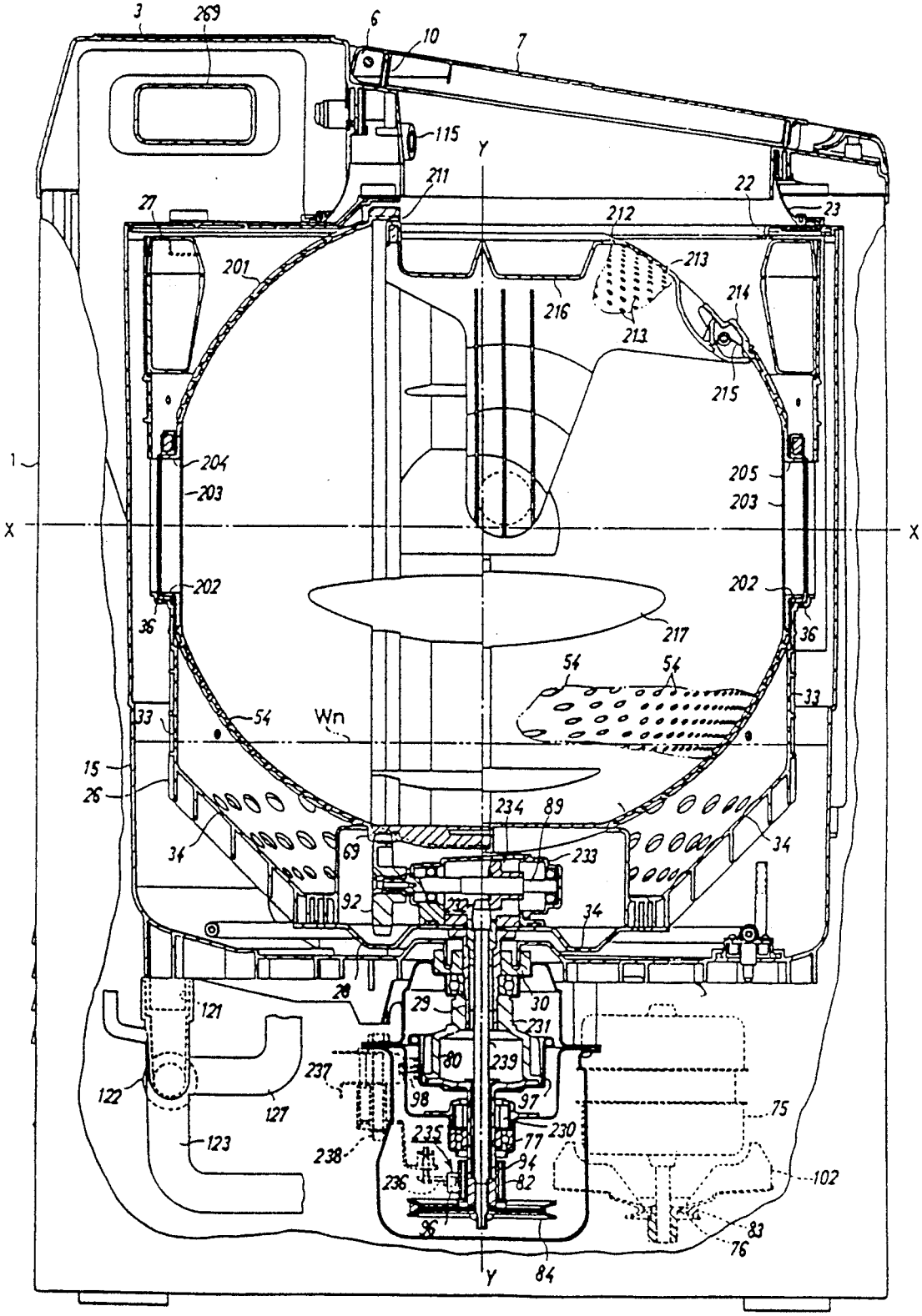

A second embodiment of this invention is explained referring to FIGS. 19 and 20. Especially, what is different from the first embodiment is explained.

The construction of the machine in accordance with the second embodiment of FIG. 19 is basically similar to that of FIG. 1. Where parts in the first and second embodiments are the same, reference numerals in FIG. 19 are the same as those of the corresponding parts in FIG. 1.

STRUCTURE OF INNER TUB

An inner tub 201 is molded in a sphere from synthetic resin. The inner tub 201 has a pair of front and rear cylindrical members 202 on its outer periphery. The rear cylindrical member 202 has an air inlet 204 for introducing warm air into the inner tub 201 and the front cylindrical member 202 has an air outlet 205 for exhausting warm air outside the inner tub 201. The inner tub 201 has a pair of boards 206 of synthetic resin. The diameter of the boards 206 is larger than that of the cylindrical members 202 of the inner tub 201. The boards 206 have multiple hooks 207 on their outer peripheries. By engaging or disengaging the hooks 207 in or from eyes 208 in the inner tub 201, the boards 206 can be attached to or detached from the inner tub 201. The pair of the boards 206 are arranged in parallel in both sides of the inner tub 201, covering the air inlet 204 and the air outlet 205 in the cylindrical members 202 of the inner tub 201. As shown in FIG. 20, the board 206 have vent pores 209 for allowing warm air to pass through and drain pores 210 for allowing warm air as well as water to pass through. The boards 206 thus prevent the laundry from jumping out of the inner tub 201, while they allow warm air to pass. By engaging the cylindrical members 202 of the inner tub 201 with the bearings 36 of the rotary supporter 26, the inner tub 201 is supported in the rotary supporter 26 and is rotatable around the horizontal axis X—X. When the laundry is washed and rinsed, the inner tub 201 is rotated about the horizontal axis X—X. An opening 211 through which the laundry is loaded is formed in the periphery of the inner tub 201 and is opposed to the opening 22 in the outer tub 15. A lid 212 of synthetic resin having multiple pores 213 is rotatably supported to open or close the opening 211 in the inner tub 201. A hook 214 of synthetic resin is rotatably supported in the lid 212. By engaging the hook 214 with the edge of the opening 211 using spring force, the lid 212 is closed. Reversing members 216 and 217 for reversing the laundry are formed in parallel with the horizontally axis X—X of the inner tub 201, respectively, in the lid 212 and the inner tub 201.

OPERATION OF INNER TUB

The machine of the second embodiment washes, rinses, dehydrates, rinses, and dries the laundry loaded in the inner tub 201.

The laundry is loaded through the opening 211 into the inner tub 201. The lid 212 is rotated to its closed position and locked by the hook 214. Subsequently, the drain valve 122 closes and the spring clutch 94 disengages, thus putting the inner-tub rotating drive mechanism 99 in operation.

Subsequently, water is supplied through the water outlet 115 into the outer tub 15. When water in the outer tub 15 reaches a predetermined (not shown) level in the inner tub 201, the motor 75 starts rotating, thus starting the washing process.

When the inner tub 201 rotates about the horizontal axis X—X, the reversing members 216 and 217 tumble the laundry in the inner tub 201. The boards 206 also beat the laundry close to the cylindrical members 202 of the inner tub 201. The inner tub 201 rotates forward and in reverse, continuing the washing process.

When the laundry is rinsed, in the same way as the washing process, the inner tub 201 rotates about the horizontal axis X—X. Water is continuously supplied through the water outlet 115 to reach a level Wn in of the inner tub 201, and at the same time water used for rinsing the laundry is discharged through the overflow water outlet 125 outside the outer tub 15. The level of water is thus kept constant.

When the laundry is dehydrated, the drain valve 122 opens, the spring clutch 94 connects, and the brake body 98 disengages from the brake drum 97, thus putting the dehydrating drive mechanism 100 into operation. The rotary supporter 26, then driven by the motor 75, rotates about the vertical axis Y—Y to dehydrate the laundry. The inner tub 201 rotates together with the rotary supporter 26 about the vertical axis Y—Y in the same direction at the same speed. The inner tub 201 is restrained from rotating about the horizontal axis X—X.

EFFECT OF THE INNER TUB OPERATION

The inner tub 201, in the same way as the first embodiment, rinses, dehydrates, rinses and dries the laundry contained therein.

The boards 206 detachably attached inside the inner tub 201 of the second embodiment are larger in diameter than the cylindrical members 202 of the inner tub 201.

The boards 206 comprising the drain holes 210 and the hooks 207 increase the rotation amount of the laundry close to the cylindrical members 202 of the inner tub 201. Although the boards 206 cover the air inlet 204 and the air outlet 205, the boards 206 having pores 209 and 210 let warm air in and out of the inner tub 201. When the laundry is dehydrated, small articles of the laundry are prevented from jumping out of the inner tub 201 through the cylindrical members 202.

A third embodiment of this invention is explained referring to FIGS. 21 through 26. What is different from the first embodiment is explained. Where parts in the first through third embodiments are the same, reference numerals in FIGS. 21 through 26 are the same as those of the corresponding parts.

STRUCTURE OF OUTER TUB

Figure 23:
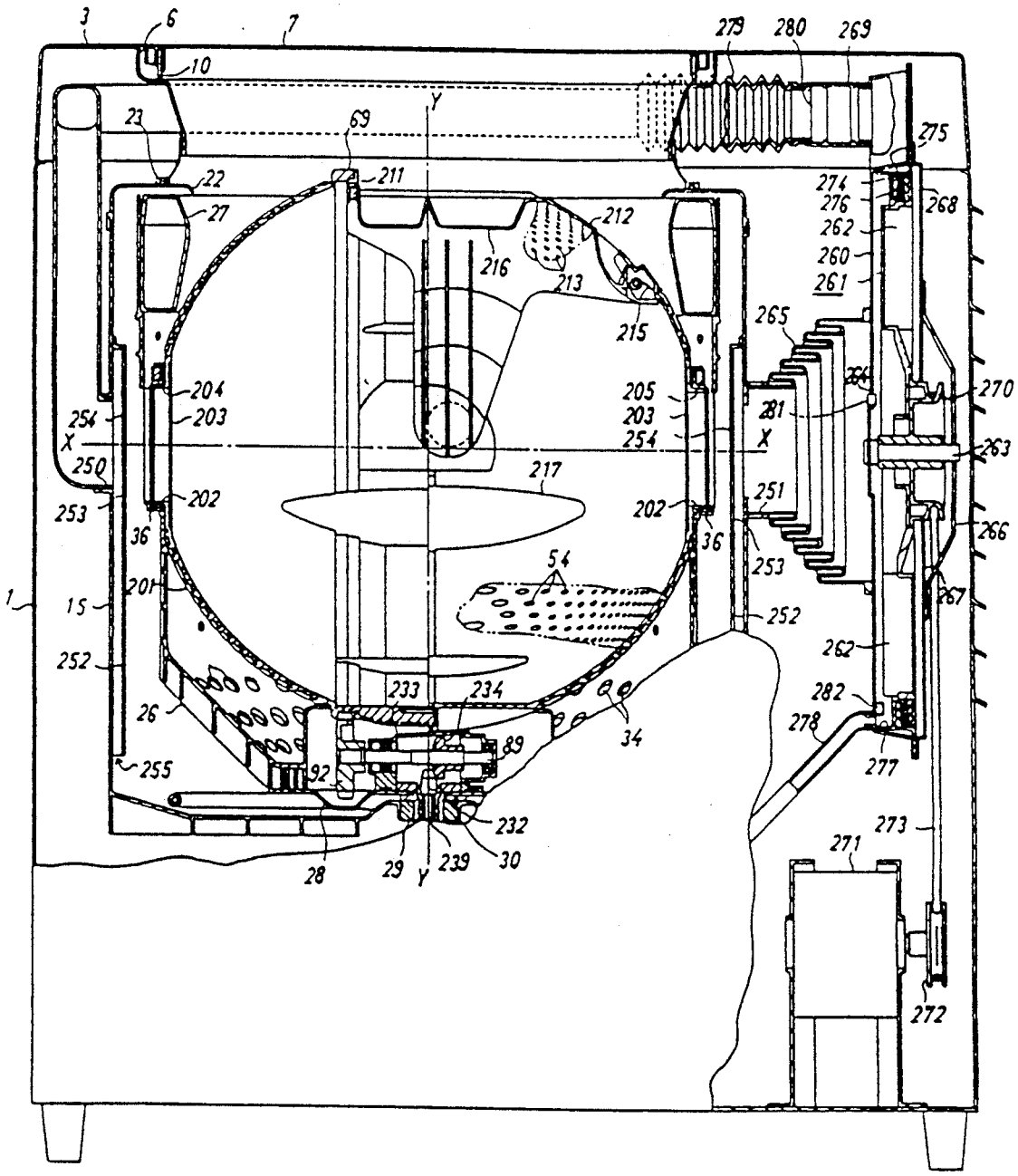

As shown in FIGS. 21 through 24, an air inlet 250 and an air outlet 251 are provided above the axis $V_2$—$V_2$ in the periphery of the outer tub 15. When the cylindrical members 202 having guard nets 203 of the inner tub 201 are on the axis $V_2$—$V_2$, the air inlet 204 and the air outlet 205 of the inner tub 201 oppose the air inlet 250 and the air outlet 251 of the outer tub 15, respectively. The guard nets 203, provided in the cylindrical members 202 of the inner tub 201, prevent the laundry from jumping out of the inner tub 201. By engaging the hook 214 of synthetic resin with the edge of the opening 211, the force of a spring 215 is exerted on the hook 214, thus locking the lid 212. The air inlet 250 and the air outlet 251 of the outer tub 15 are smaller in diameter than the air inlet 204 and the air outlet 205 of the inner tub 201. As shown in FIG. 23, guide boards 252 provided side by side in the outer tub 15 extend downward and face the air inlet 250 and the air outlet 251. Bubble outlets 253 in the guide boards 252 have finely meshed filters 254. Openings 255 are between the lower ends of the guide boards 252 and the bottom of the outer tub 15. The filters 254 prevent bubbles in the outer tub 15 from flowing outside the outer tub 15, convert bubbles into droplets, and allow air to pass through. The droplets of bubbles on the filters 254 descend along the guide boards 252.

STRUCTURE OF DEHUMIDIFIER FOR THE SECOND EMBODIMENT

A fan case 260 is fixed to the housing 1 at a side of the outer tub 15. A fan 261 having a corrugation 262 on its outer periphery is rotatably supported on a horizontal shaft 263 in the fan case 260. A suction cavity 264 in the middle of the fan case 260 is opposite to the air outlet 251. Bellows 265 interposes between the outer tub 15 and the fan case 260 to cover the suction cavity 264 and the air outlet 251. A board 266 fixed onto the fan case 260 supports one end of the horizontal shaft 263. Pores 267 and 268 are provided in the outer periphery of the fan case 260. A warm-air supply pipe 269 is connected to the upper end of the fan case 260, and a pulley 270 is in the middle of the fan 261. A motor 271 is fixed onto the bottom of the housing 1, and a pulley 272 is attached to the output shaft of the motor 271. A belt 273 connects the pulley 272 to the pulley 270. The motor 271 rotates the fan 261. The air outlets 205 and 251 and the bellows 265 compose an exhaust passage for exhausting humid air used for drying the laundry outside the outer tub 15. The fan case 260, the fan 261 and the motor 271 dehumidify the air guided from the exhaust passage by condensing the moisture in the air to dewdrops.

Multiple ridges 274 around the outer periphery of the fan 261 are concentric with the fan 261. An annular guide 275 on the outer periphery of the fan case 260 has multiple ridges 276 between the ridges 274 of the fan 261. The space between the ridges 274 and 276 is so small that air inside and outside the fan 261 is prevented from mixing. Dewdrops created according to the rotation of the fan 261 fall along a dewdrops guide 277 of the guides 275 due to their weight. Dewdrops are further drained along the dewdrops guide 277 through a flexible exhaust pipe 278 to the outside.

The warm-air supply pipe 269 runs from the fan case 260 along the upper part of the housing 1 down to the side of the housing 1 and connects to the air inlet 250. Bellows 279, a part of the warm-air supply pipe 269, absorbs the vibration of the outer tub 15. A heater 280 in the upstream side of the warm-air supply pipe 269 heats air flowing through the warm-air supply pipe 269. Temperature sensors 281 and 282, provided where warm air passes, detect the temperature of warm air flowing in the fan case 260.

DRIVE MECHANISM OF INNER TUB AND ROTARY SUPPORTER

The motor 75 for rotating the inner tub 201 and the rotary supporter 26 can rotate forward and in reverse. The driven pulley 76 provided with the fan 102 is attached to the motor 75 under the outer tub 15. The lower hollow shaft 77 is in line with the upper hollow shaft 29. The lower hollow shaft 77 connected to the upper hollow shaft 29 is rotatably supported by the support board 78, the bearing 79, and a clutch 230 and the gear housing 80. An rotary supporter drive shaft 231 comprises the upper and lower hollow shafts 29 and 77 and the gear housing 80. A rotating drive shaft 239 is supported via a metal in the rotary supporter drive shaft 231 so that the shaft 239 rotates relative to the shaft 231. The lower end of the rotating drive shaft 239 connects the non-driven pulley 84 linked via the belt 83 with the driven pulley 76. The drive mechanism including the motor 75 and the rotating drive shaft 239 rotates the inner tub 201 and the rotary supporter 26. A pinion 232 is fixed to the upper end of the rotating drive shaft 239. A gear cover 233 of synthetic resin is watertight, supported via the packing 88 onto the support board 78 in the rotary supporter 26. A hypoid gear 234 fixed via the bearing 90 onto the non-driven rotating shaft 89 meshes with the pinion 232 in the gear cover 233. The end of the non-driven rotating shaft 89 connects to the driven gear 92 which meshes with the non-driven gear 69 at the bottom of the inner tub 201. The non-driven gear 69 and the driven gear 92 transmit drive force to the inner tub 201. The spring clutch 94 is around the outer periphery of the clutch coupling 82. When the clutch click 95 is detached from the clutch housing 96, drive force is transmitted through the spring clutch 94 to the lower hollow shaft 77 connected to the rotating drive shaft 239. On the other hand, when the clutch click 95 engages the clutch housing 96, the lower hollow shaft 77 disconnects from the rotating drive shaft 239. A switching mechanism 235 comprises the spring clutch 94, the clutch click 95 and a clutch lever 236. The brake drum 97 is fixed onto the outer periphery of the gear housing 80. A brake lever 237 rotates on a support 238 of the support board 78. A brake body 98 is on the brake lever 237. When the brake body 98 contacts the brake drum 97, the upper and lower hollow shafts 29 and 77 and the gear housing 80 are stopped, thereby restraining the rotary supporter 26 from rotating. When the spring clutch 94 is released and the brake body 98 contacts the brake drum 97, the inner tub 201 can rotate about the horizontal axis X—X. When the spring clutch 94 engages the lower hollow shaft 77 and the brake body 98 disconnects from the brake drum 97, the rotary supporter 26 can rotate about the vertical axis Y—Y. The rotating drive shaft 239 rotates the rotary supporter drive shaft 231 in the same direction at the same speed, thus rotating the inner tub 201 and the rotary supporter 26 altogether about the vertical axis Y—Y, when the inner tub 201 is prevented from rotating about the horizontal axis X—X.

The inner-tub rotating drive mechanism 99 comprises the non-driven rotating shaft 89 and the non driven gear 69.

The dehydrating drive mechanism 100 comprises the upper and lower hollow shafts 29 and 77, the gear housing 80 and the spring clutch 94. To wash, rinse and dry the laundry, the inner-tub rotating mechanism 99 rotates the inner tub 201 about the horizontal axis X—X. To dehydrate the laundry, the dehydrating drive mechanism 100 rotates the inner tub 201 and the rotary supporter 26 about the vertical axis Y—Y.

DRYING AND DEHUMIDIFYING PROCESSES

Figure 24:
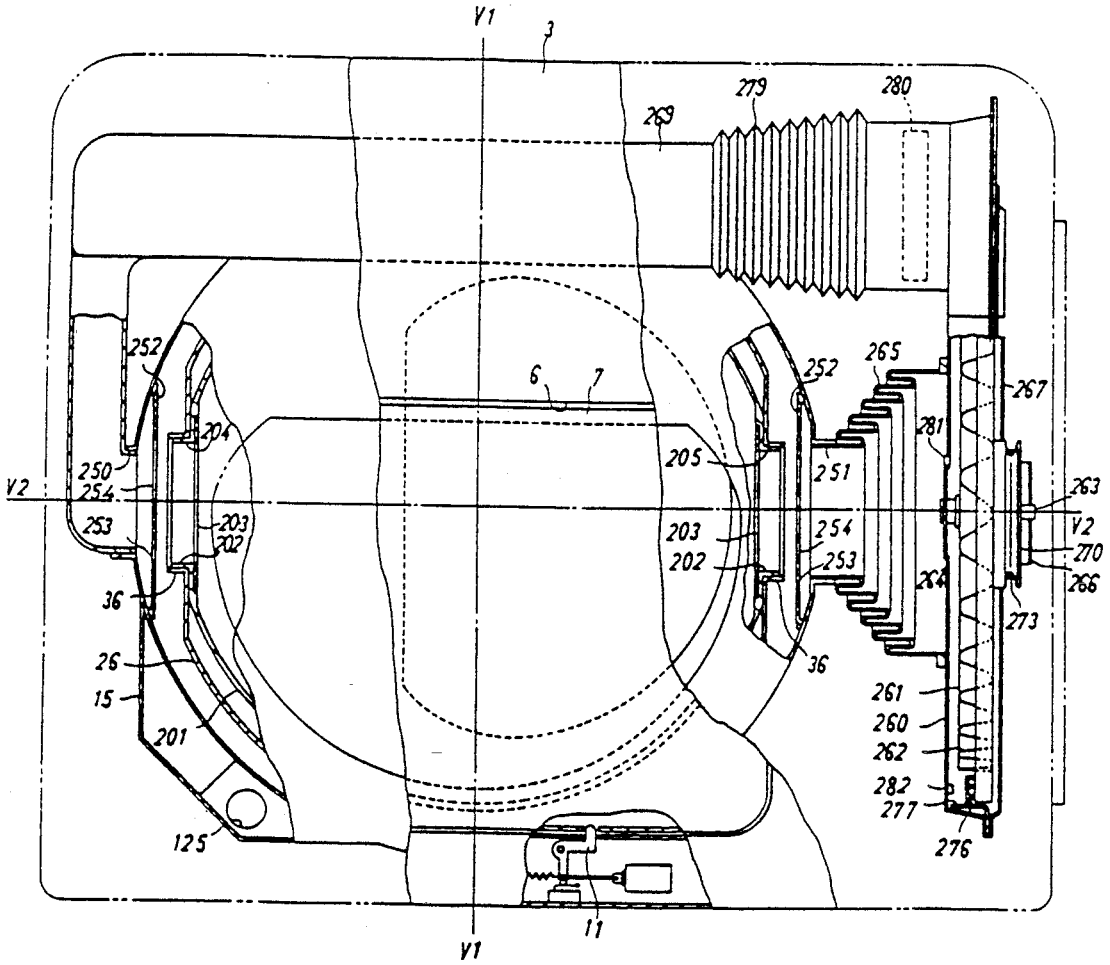
Figure 25:
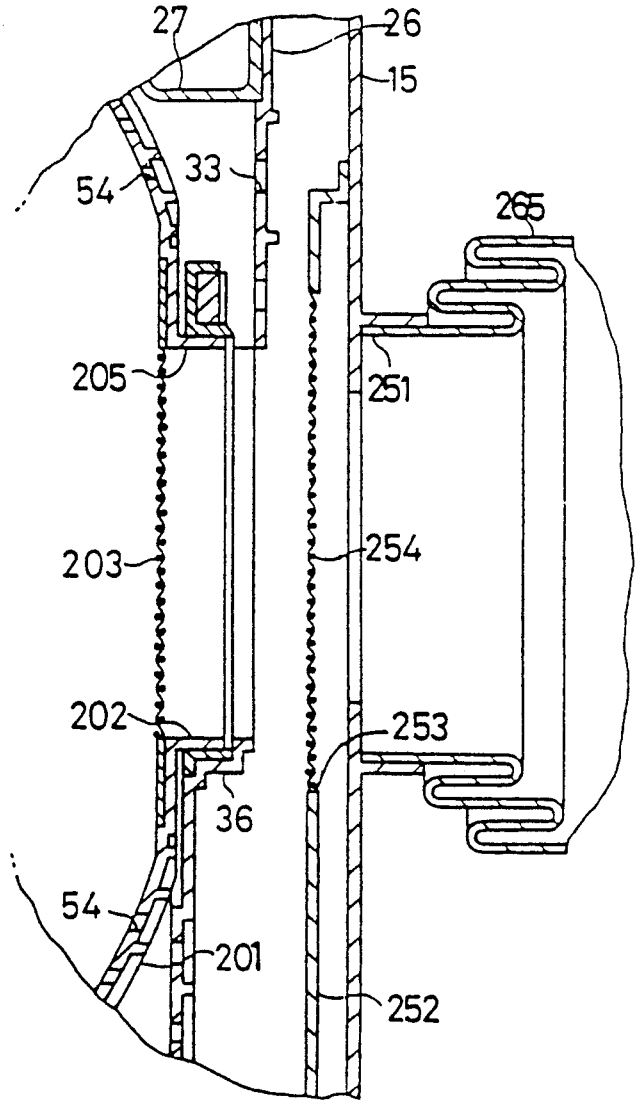

As shown in FIG. 24, when the laundry is dried, the rotary supporter 26 rotates, aligning the cylindrical members 202 of the inner tub 201 on the axis $V_2$—$V_2$. The cylindrical members 202 of the inner tub 201 are opposite to the air inlet 250 and the air outlet 251 of the outer tub 15. The inner tub 201 rotates about the horizontal axis X—X. The motors 271, the heater 280 and the fan 261 generate warm air. Warm air is supplied through the warm-air supply pipe 269 into the inner tub 201 where the agitated laundry is dried.

On the other hand, after the laundry is dried or when the drying process is discontinued, the cylindrical members 202 of the inner tub 201 are aligned on a front-to-rear horizontal axis $V_1$—$V_1$. Since the inner tub 201 stops with the opening 211 facing the opening 6, the laundry can easily be loaded or unloaded.

When warm air used for drying the laundry is dehumidified, the motor 271 transmits drive force through the pulleys 272, the belt 273 and the pulley 270, rotating the fan 261. When the fan 261 rotates, the humid air in the outer tub 15 and the inner tub 201 is taken into the middle of the fan 261. The humid air is sent toward the outer periphery of the fan 261 due to the centrifugal force of the rotating fan 261. Subsequently, the humid air reaches the warm-air supply pipe 269. On the other hand, air outside the fan case 260 is introduced through the pore 267 into the fan case 260 and exhausted through the pore 268 to the outside. The fan 261 thus exchanges heat from inside to outside the fan case 260. When the air inside the fan 261 is hot and humid, the air is cooled and condensed into dewdrops. The fan 261 rotates, dispersing the dewdrops to the outside of the fan 261. The dewdrops are discharged through the guide 277 and the exhaust pipe 278.

Dehumidified warm air is heated in the heater 280 and is supplied through the warm-air supply pipe 269 into the outer tub 15. The warm air is introduced through the inner tub 201, the air outlets 250, 251, the bellows 265, and the exhaust passage into the fan case 260 where the warm air is dehumidified and is sent to the heater 280.

DRYING AND DEHUMIDIFYING PROCESSES

The machine for the third embodiment continuously washes, rinses, dehydrates, and dries the laundry. In addition, the machine is provided with the dehumidifier, preventing humid air used for the drying process from being exhausted to the atmosphere.

As shown in FIG. 23, in the dehumidifier, the fan 261 in the fan case 260 rotates, sends and exhausts warm air, and exchanges heat inside and outside the fan case 260.

During the drying process, air is taken into the center of the fan 261 and brought to the outer periphery of the fan 261 due to the centrifugal force caused by the rotation of the fan 261. Subsequently, the air is heated in the heater 280 and is supplied through the warm-air supply pipe 269 into the inner tub 201. The laundry in the inner tub 201 is exposed to the air and dried. The fan 261 rotates to take the air used for the drying process into the fan 261 and exhaust the dehumidified air out of the inner tub 201.

Figure 26:
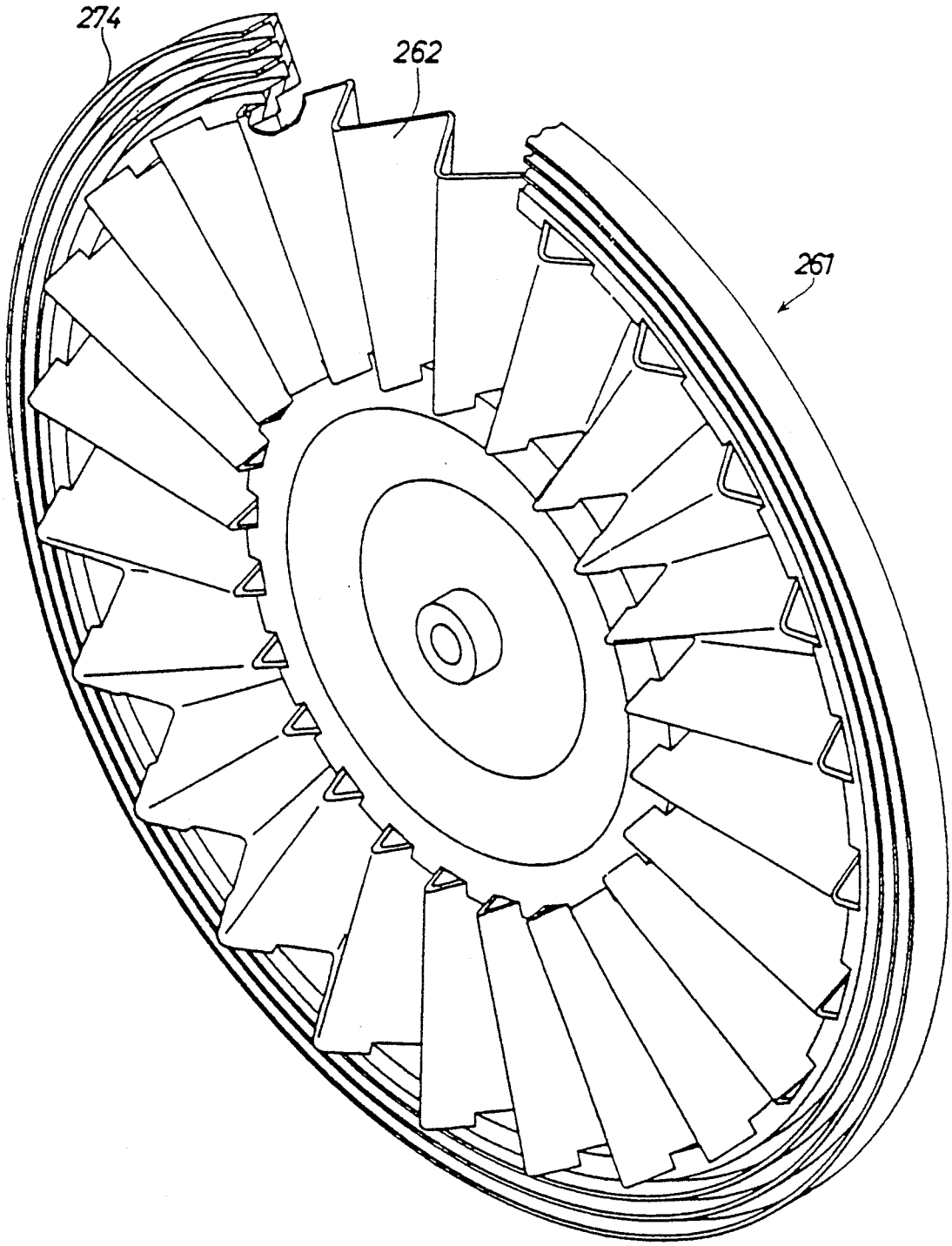

The humid air which has been used for the drying process is taken into the fan 261 and sent to the outer periphery of the fan 261. At the same time, the air outside the fan case 260 is taken into the fan 261 and is sent to the outer periphery of the fan 261. Consequently, the hot and humid air in the fan case 260 is cooled by the air outside the fan case 260, and is condensed to dewdrops. The hot and humid air is thus dehumidified by exchanging heat inside and outside the fan 261. After dehumidifying, the air goes back into the heater 280 according to the rotation of the fan 261. The air used for the drying process is thus prevented from going out of the machine. The dewdrops resulting from the dehumidifying process are discharged through the guide 277 and the exhaust pipe 278 to the outside of the machine. As shown in FIG. 26, heat inside and outside of the fan 261 is exchanged at the corrugation 262 of the fan 261. As aforementioned, warm air is supplied into and exhausted from the inner tub 201, and is dehumidified.

In the machine of the third embodiment, the guide boards 252 having the finely meshed filter 254 are provided opposite to the air inlet 250 and the air outlet 251 of the outer tub 15. The filter 254 hinders bubbles resulting from the beginning of the washing and rinsing processes from flowing out of the air inlet 250 and the air outlet 251 of the outer tub 15. The bubbles trying to flow out of the outer tub 15 contact the fine meshes in the filter 254 and break. Consequently, the bubbles are converted to water droplets. The water droplets fall along the guide board 252 through the lower opening 255 down back to washing water pooled in the bottom of the outer tub 15. Consequently, short-circuit of the heater 280 and the defective rotation of the fan 261 are prevented from occurring due to bubbles sticking to the heater 280 and the fan 261. On the other hand, the outflow of bubbles are obstructed within the outer tub 15, and the bubbles are converted to droplets. Since the droplets are returned to washing water, the amount of the washing water in the outer tub is not decreased. The filter 254 let warm air into and out of the inner tub 201 for the drying process. The structure for eliminating bubbles is no obstruction to the drying process.

A fourth embodiment of this invention is now explained referring to FIGS. 27A through 29. The numerals of components are identical with those of the corresponding components for the first, second and third embodiments.

DRYING PROCESS FOR THE FOURTH EMBODIMENT

Figure 27A:
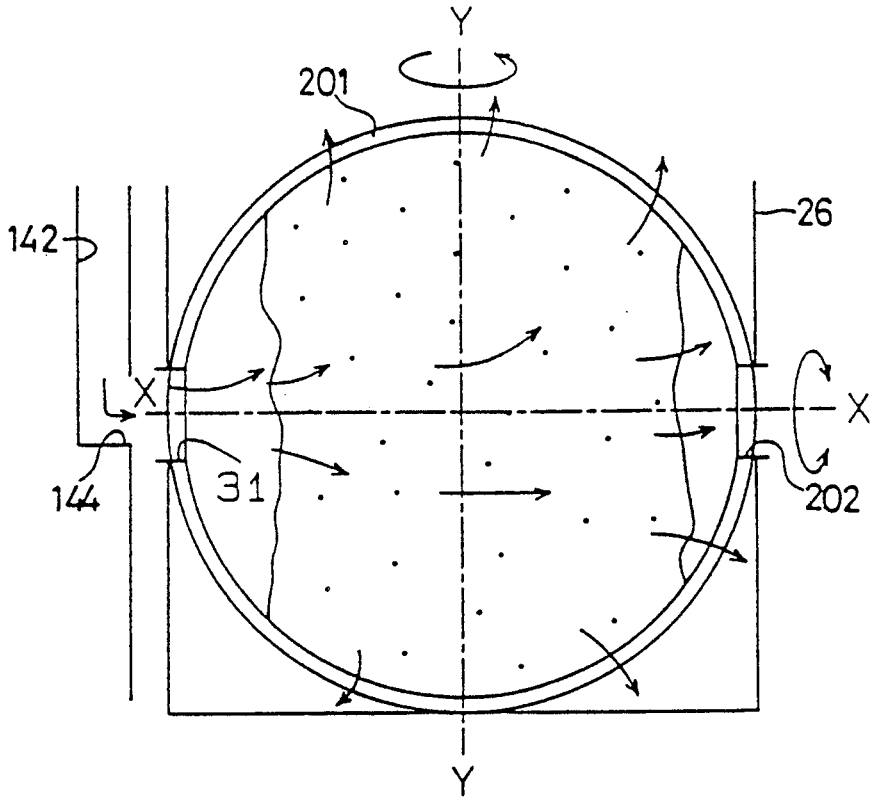
Figure 27B:
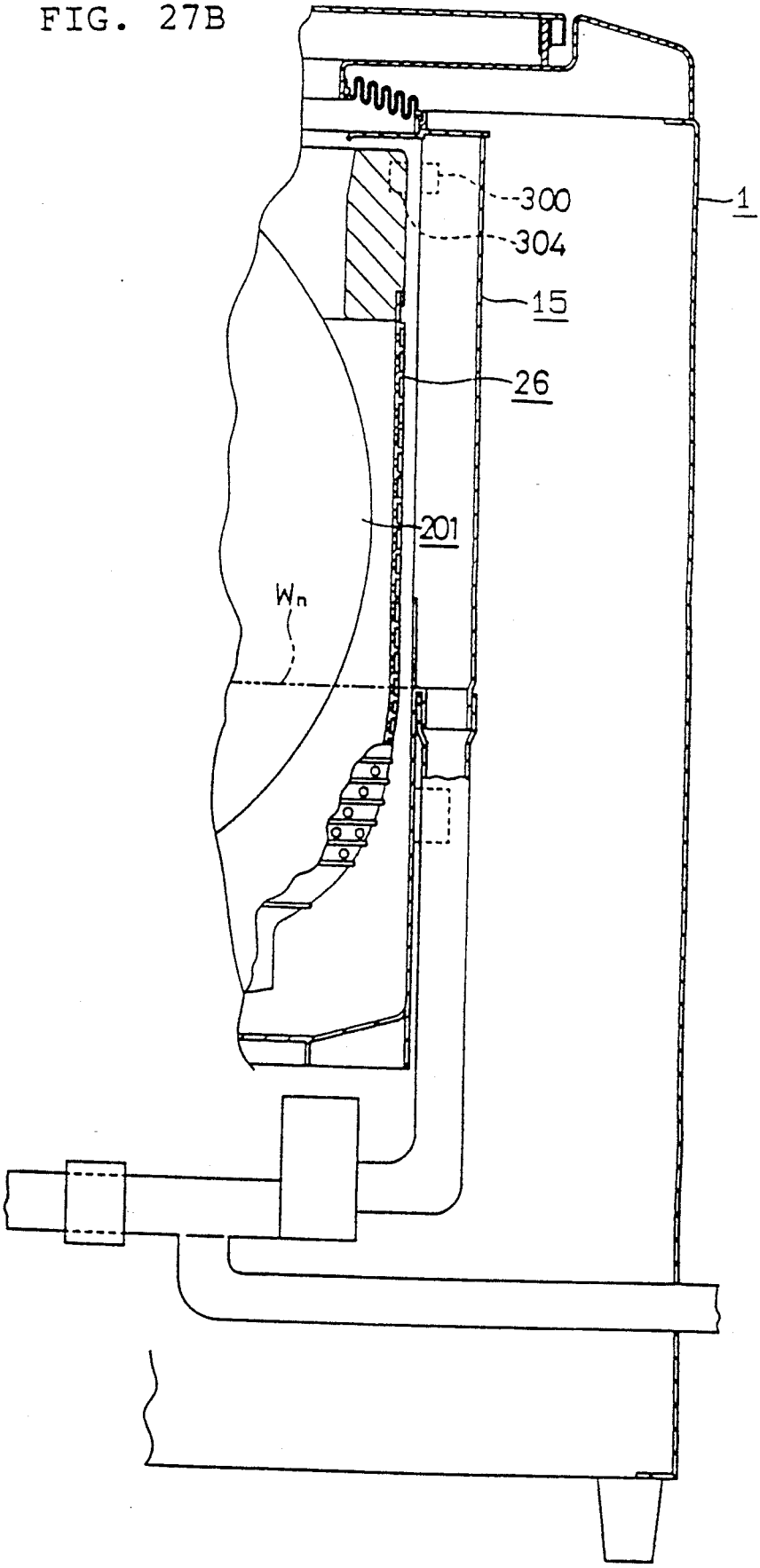
FIG. 27B is a partial cross-sectional view of the side of an outer tub.
Figure 28:
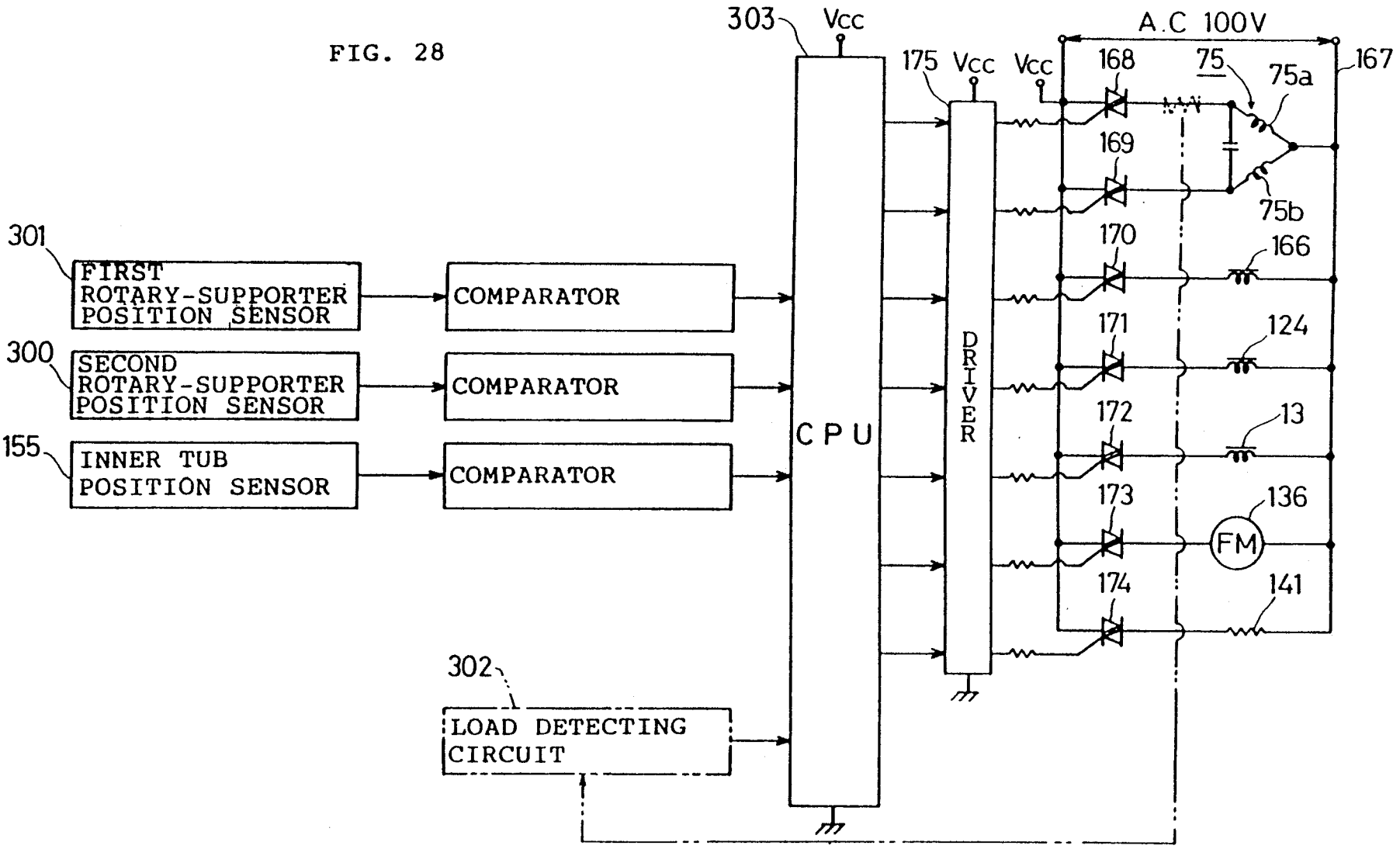
Figure 29:
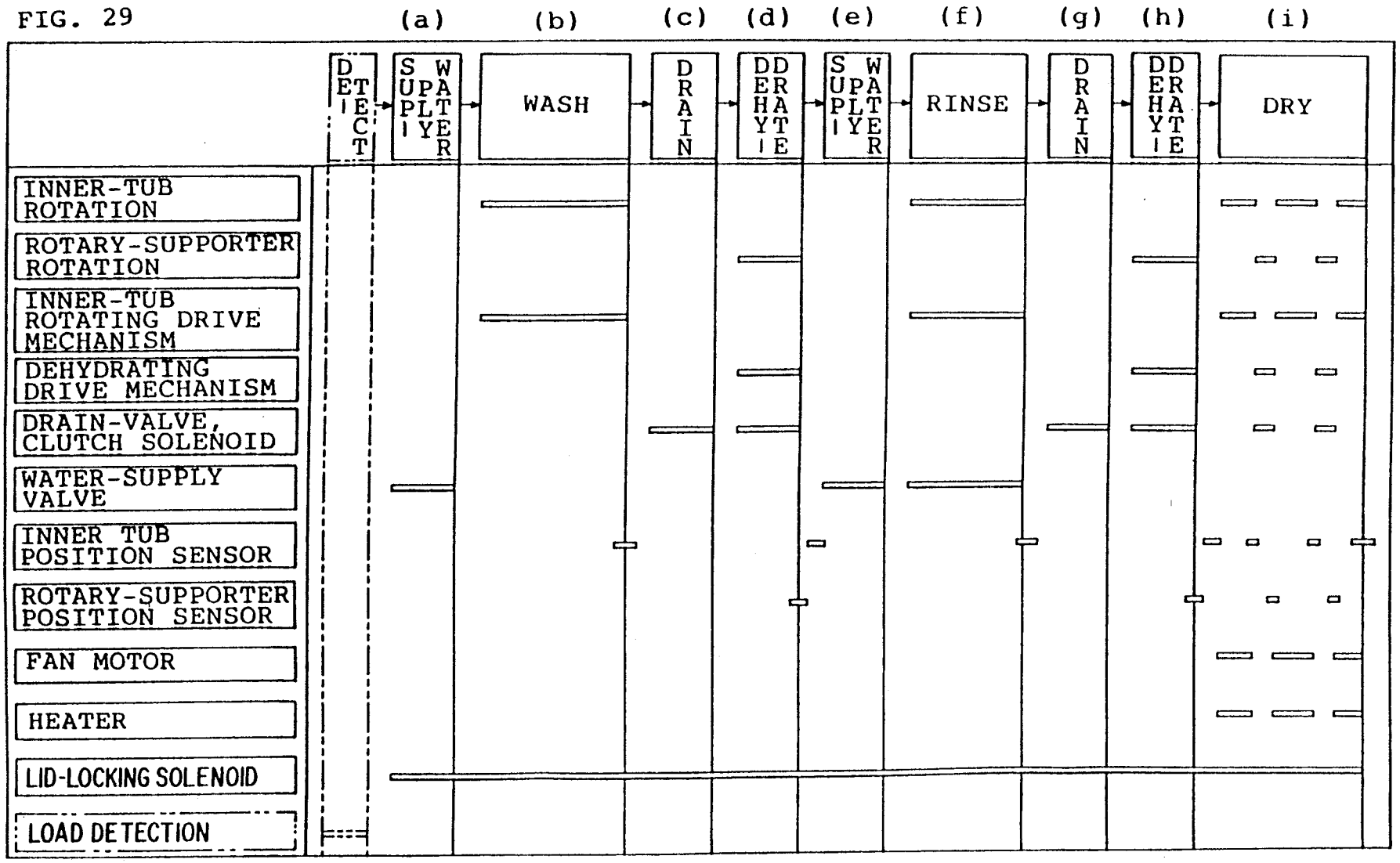

FIG. 27A shows the drying operation of the inner tub. FIG. 27B is a partial cross sectional view of the side of the outer tub. FIG. 28 is a block diagram of a control circuit. FIG. 29 is a time chart of the machine for the fourth embodiment.

The drying operation of the fourth embodiment is the same as that of the second embodiment. However, different from the second embodiment, the following operation is added to the drying operation of the fourth embodiment.

In the course of the drying operation, the inner-tub rotating drive mechanism 99 and the supply of warm air into the inner tub are stopped temporarily, and the dehydrating drive mechanism 100 rotates the inner tub 201 together with the rotary supporter 26 by 180 degrees about the vertical axis Y—Y. Subsequently, the inner tub 201 and the rotary supporter 26 are stopped at the predetermined position when a magnet 304 in the rotary supporter 26 is detected by a second rotary supporter position sensor 300. The predetermined position deviates 180 degrees from the position prior to the rotation of the inner tub 201 and the rotary supporter 26. The cylindrical members 202 of the inner tub 201 replace each other in position. Specifically, the air inlet 204 of the inner tub 201, which faces the air inlet 250 of the outer tub 15 prior to the rotation, faces the air outlet 251 of the outer tub 15 when the inner tub 201 stops at the predetermined position. On the other hand, the air outlet 205 of the inner tub 201, which faces the air outlet 251 of the outer tub 15 prior to the rotation, faces the air inlet 250 of the outer tub when the inner tub 201 stops at the predetermined position.

Subsequently, the inner-tub rotating drive mechanism 99 is driven again and warm air is supplied again, restarting the drying process for a prescribed time period. The drying process is discontinued. The inner tub 201 and the rotary supporter 26 are driven by the dehydrating drive mechanism 100 to rotate 180 degrees. When a magnet 305 in the rotary supporter 26 is detected by a first rotary supporter position sensor 301, the rotary supporter 26 and the inner tub 201 are stopped at the predetermined position which deviates 180 degrees from the position prior to the rotation. Through the aforementioned operation warm air is supplied through both cylindrical members 202 to the laundry in the inner tub 201. By altering the program in the control circuit, the number of times of rotation and the time period of the drying process can be determined at will. When a load detecting circuit 302 detects the load of the laundry to be dried, a CPU 303 can automatically set the times of the rotation and the time period of the drying process according to the detected load.

In the machine of the fourth embodiment, the laundry concentrated close to the rotation axis of the inner tub 201 can be effectively dried. Since warm air is alternately supplied through both cylindrical members 202 of the inner tub 201, the laundry can be uniformly dried.

Figure 31:
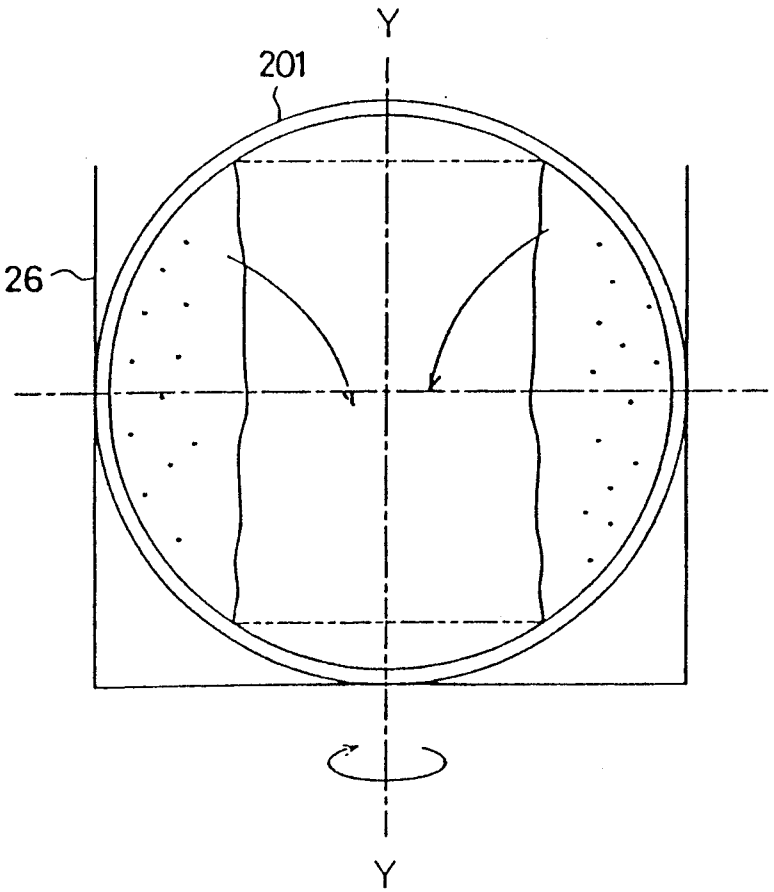
FIGS. 30 and 31 show a fifth embodiment of this invention.
Figure 30:
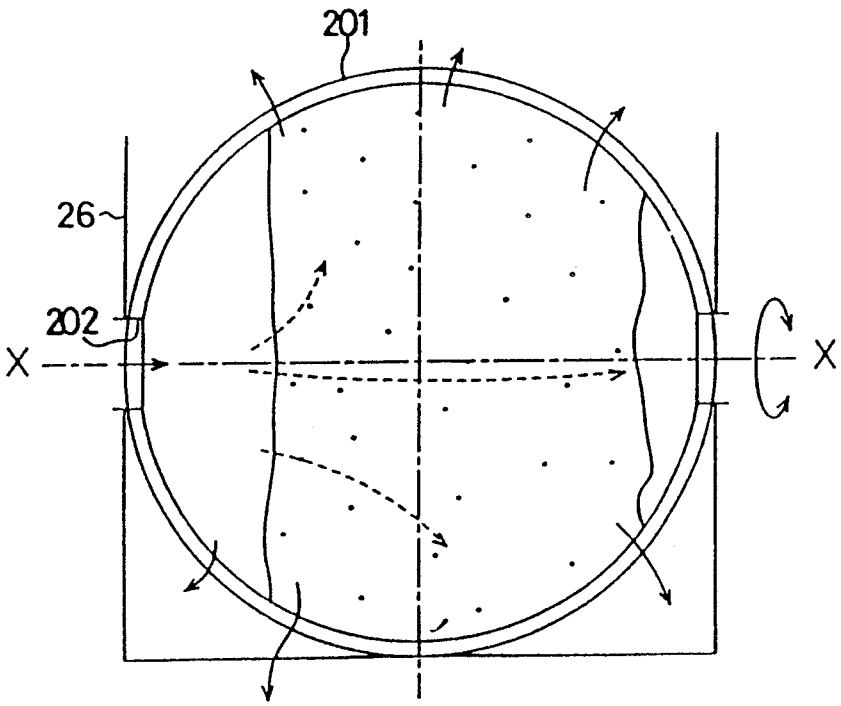

A fifth embodiment of this invention is explained referring to FIG. 28, 30 and 31. The numerals of the components for the fifth embodiment are the same as those of the corresponding components for the first through fourth embodiments.

DRYING PROCESS

The drying process of the fifth embodiment is the same as that of the first through third embodiments. However, in the fifth embodiment, the following operation is added in the course of the drying process.

In the course of the drying process, the operation of the inner-tub rotating drive mechanism 99 and the supply of warm air are stopped temporarily. The inner tub 201, driven by the dehydrating drive mechanism 100, rotates together with the rotary supporter 26 about the vertical axis Y—Y for a prescribed time period, when the inner tub 201 is restrained from rotating about the horizontal axis X—X. After the predetermined time period, the dehydrating drive mechanism 100 is stopped. Subsequently, in the same way as the first embodiment, the rotary supporter 26 is stopped at the predetermined position with the cylindrical members 202 of the inner tub 201 arranged on the axis $V_2$—$V_2$ through the routine for the positioned stop of the rotary supporter 26 described in the first embodiment. The inner tub 201, driven by the inner-tub rotating drive mechanism 99, rotates about the horizontal axis X—X, and warm air is supplied, restarting the drying process. This operation is repeated several times. It is arbitrarily determined how many times the operation is repeated by altering control program. Alternatively, by detecting the amount of the laundry to be dried by means of the load detecting circuit 302, the CPU 303 can automatically set the times of the repetition of the operation can be automatically set.

During the drying process even the laundry concentrated around the horizontal axis X—X of the rotating inner tub 201 can be dried. As shown in FIGS. 30 and 31, the centralized laundry is moved toward the sides of the inner tub 201. The laundry can be uniformly exposed to warm air to dry.

Although specific embodiments of the invention have been described for the purpose of illustration, the invention is not limited to these embodiments. This invention includes all embodiments and modifications that come within the scope of the claims.

What is claimed is:

1. A machine for washing, removing water from and drying laundry, where the laundry is damp after the water is removed, comprising:

an outer tub;

a water supply and drain means for supplying water to and draining water out of the outer tub;

a rotation-support member rotatably supported about a vertical axis in the outer tub;

an inner tub, having multiple pores in its periphery and being rotatably supported about a horizontal axis by the rotation-support member, for containing the laundry;

an inner-tub rotating means for rotating the inner tub;

a rotation drive means connected to the inner-tub rotating means for driving the inner-tub rotating means;

a rotation-support member rotating means detachably attached to the rotation drive means; and a heating means for raising the temperature of air in the inner tub, said heating means comprising:

a warm-air supply passage having an opening in the periphery of the outer tub for guiding air heated by the heating means into the outer tub at least during the drying process of an inner tub;

warm-air inlets provided in the periphery of the inner tub for guiding into the inner tub warm air discharged from the opening into the outer tub; and an exhaust-air passage provided far from the warm-air supply passage in the periphery of the outer tub for exhausting air out of the outer tub, the air having been used for drying the laundry and scattered from the inner tub into the outer tub; wherein:

the rotation-support member rotating means controls the rotation of the rotation-support member and allows the inner tub to rotate about the horizontal axis when the rotation-support member rotating means is detached from the rotation drive means;

the rotation-support member rotating means rotates the rotation-support member and the inner tub at the same speed in the same direction about the vertical axis and controls the rotation of the inner tub relative to the rotation-support member when the rotation-support member rotating means is connected to the rotation drive means;

the machine washes and rinses the laundry by rotating the inner tub about the horizontal axis when the water supply and drain means supplies water into the outer tub so that the water reaches a predetermined level (L1, L2) inside the inner tub, the inner tub is loaded with the laundry, and the rotation-support member rotating means is detached from the rotation drive means;

the machine removes water from the laundry, after washing and rinsing the laundry, in the inner tub by rotating the rotation-support member about the vertical axis when the water supply and drain means drains water from the outer tub and the rotation-support member rotating means is connected to the rotation drive means; and the machine dries the laundry, after water is removed from the laundry, in the inner tub when the rotation-support member rotating means is disconnected from the rotation drive means, the inner tub is rotated about the horizontal axis, and the heating means raises the temperature of air in the inner tub.

2. A machine for washing, removing water from and drying laundry as in claim 1 in which the heating means further comprises:

a heater for heating air; and a fan for positively introducing and exhausting air heated by the heater into and out of the inner tub.

3. A machine for washing, removing water from and drying laundry as in claim 2 in which the warm-air supply passage comprises a filter for obstructing soap bubbles resulting from the washing process of the inner tub and passing warm air through.

4. A machine for washing, removing water from and drying laundry as in claim 1 in which the warm-air inlets are opposite to each other along a horizontal axis in the periphery of the inner tub and warm air is alternately supplied from the warm-air inlets into the inner tub by operating the switching means in the course of the drying process, connecting the rotation-support member rotating means to the rotation drive means, and rotating the rotation-support member at least 180 degrees.

5. A machine for washing, removing water from and drying machine as in claim 4 in which the inner tub is formed almost in a sphere and has inside boards having air pores for covering the warm-air inlets while letting in warm air.

6. A machine for washing, removing water from and drying laundry as in claim 4 in which the warm-air supply passage comprises a filter for obstructing soap bubbles resulting from the washing process of the inner tub and passing warm air through.

7. A machine for washing, removing water from and drying laundry as in claim 1 in which the inner tub has hollow rotating shafts rotatably supported around the horizontal axis by the rotation-support member, and the hollow rotating shaft forms the warm-air inlets of the inner tub.

8. A machine for washing, removing water from and drying machine as in claim 7 in which the inner tub is formed almost in a sphere and has inside boards having air pores for covering the warm-air inlets while letting in warm air.

9. A machine for washing, removing water from and drying machine as in claim 1 in which the inner tub is formed almost in a sphere and has inside boards having air pores for covering the warm-air inlets while letting in warm air.

10. A machine for washing, removing water from and drying laundry as in claim 1 in which the exhaust-air passage further comprises a dehumidifying means for condensing moisture in air discharged from the outer tub.

11. A machine for washing, removing water from and drying laundry as in claim 10 in which the dehumidifying means comprises:

a drain passage for draining the moisture condensed; and a circulating passage for guiding warm air dehumidified by the dehumidifying means into a heating means.

12. A machine for washing, removing water from and drying laundry as in claim 11 in which the dehumidifying means is provided at a side of the outer tub.

13. A machine for washing, removing water from and drying laundry as in claim 11 in which the exhaust-air passage comprises a filter for obstructing soap bubbles resulting from the washing process of the inner tub and passing warm air through.

14. A machine for washing, removing water from and drying laundry as in claim 10 in which the dehumidifying means is provided at a side of the outer tub.

15. A machine for washing, removing water from and drying laundry as in claim 14 in which the exhaust-air passage comprises a flexible bellows.

16. A machine for washing, removing water from and drying laundry as in claim 10 in which the exhaust-air passage comprises a filter for obstructing soap bubbles resulting from the washing process of the inner tub and passing warm air through.

17. A machine for washing, removing water from and drying laundry as in claim 1 in which the warm-air supply passage comprises a filter for obstructing soap bubbles resulting from the washing process of the inner tub and passing warm air through.

18. A machine for washing, removing water from and drying laundry as in claim 17 in which the filter is finely meshed.

19. A machine for washing, removing water from and drying laundry as in claim 1 in which the exhaust-air passage comprises a filter for obstructing soap bubbles resulting from the washing process of the inner tub and passing warm air through.

20. A machine for washing, removing water from and drying laundry as in claim 19 in which the filter is finely meshed.

21. A machine for washing, removing liquid from and drying laundry, comprising:

an outer tub for containing liquid;

a liquid supply and drain means for supplying liquid to and draining liquid out of the outer tub;

a rotation-support member rotatably supported about a vertical axis in the outer tub;

an inner tub, having multiple pores in its periphery and being rotatably supported about a horizontal axis by the rotation-support member, for containing the laundry;

a rotation drive means including a motor;

an inner-tub rotating means, which is provided between the rotation drive means and the inner tub, having a decelerating means for rotating the inner tub at a first speed;

a rotation-support member rotating means for attaching the rotation-support member to the rotation drive means and for transmitting a turning force to the rotation-support member;

a switching means, provided at the rotation-support member rotating means, for attaching the rotation-support member rotating means to the rotation drive means and for detaching the rotation-support member rotating means from the rotation drive means, the switching means being constructed to provide for rotation and drive of only the inner-tub rotating means by the rotation drive means, to prevent rotation of the rotation-support member and to rotate the inner tub about the horizontal axis only at the first speed, when the rotation-support member rotating means is detached from the rotation drive means, and to provide for rotation and drive of the rotation-support member rotating means together with the inner-tub rotating means and rotation of the rotation-support member and the inner tub about the vertical axis in the same direction at a second speed, which is greater than the first speed, and to prevent the rotation of the inner tub about the horizontal axis relative to the rotation-support member, when the rotation-support member rotating means is attached to the rotation drive means by the switching means;

a heating means for drying the laundry in the inner tub, the heating means comprising:

a warm-air supply passage having an opening in the peripheral wall of the outer tub on the horizontal axis of the inner tub or in the vicinity of the horizontal axis, for introducing the warm air heated by the heating means into the outer tub through the opening;

a warm-air inlet provided in the peripheral wall of the inner tub facing the opening of the outer tub on the horizontal axis or in the vicinity of the horizontal axis, for introducing the warm air, which enters the outer tub through the opening of the warm-air supply passage, into the inner tub through a space between the outer tub and the inner tub; and an exhaust-air passage having an opening in the peripheral wall of the outer tub spaced apart from the warm-air supply passage, for exhausting warm air used for drying the laundry out of the inner tub through the outer tub to the outside of the outer tub;

wherein, the machine for washing, removing liquid from and drying laundry rotates only the inner tub about the horizontal axis at the first speed for washing and rinsing the laundry in the inner tub by detaching the rotation-support member rotating means from the rotation drive means using the switching means after supplying liquid to the outer tub by the liquid supply and drain means such that the liquid reaches a predetermined level in the inner tub, rotates the inner tub and the rotation-support member about the vertical axis at a second speed for removing liquid from the laundry washed or rinsed in the inner tub by attaching the rotation-support member rotating means to the rotation drive means using the switching means after the liquid is drained out of the outer tub by the liquid supply and drain means, and rotates the inner tub about the horizontal axis for drying the laundry with warm air heated by the heating means and introduced into the inner tub substantially along the horizontal axis by detaching the rotation-support member rotating means from the rotation drive means using the switching means.

22. A machine for washing, removing liquid from and drying laundry, comprising:

an outer tub for containing liquid;

a liquid supply and drain means for supplying liquid to and draining liquid out of the outer tub;

a rotation-support member rotatably supported about a vertical axis almost parallel to the gravity direction in the outer tub;

an inner tub, having multiple pores in its periphery and being rotatably supported about a horizontal axis orthogonal to the vertical axis by the rotation-support member, for containing the laundry;

a rotation drive means including a motor;

an inner-tub rotating means, which is provided between the rotation drive means and the inner tub, connecting the rotation drive means with the inner tub, and having a decelerating means for rotating the inner tub at a first speed;

a rotation-support member rotating means for attaching the rotation-support member with the rotation drive means and transmitting a turning force to the rotation-support member;

a switching means, provided at the rotation-support member rotating means, for attaching the rotation-support member rotating means to the rotation drive means and for detaching the rotation-support member rotating means from the rotation drive means; and a heating means for drying the laundry in the inner tub;

the heating means comprising:

a warm-air supply passage having an opening in the peripheral wall of the outer tub on the horizontal axis of the inner tub or in the vicinity of the horizontal axis, for introducing the warm air heated by the heating means into the outer tub through the opening;

a warm-air inlet provided in the inner tub facing the opening of the outer tub on the horizontal axis of the inner tub or in the vicinity of the horizontal axis, for introducing the warm air, which enters the outer tub through the opening of the warm-air supply passage, into the inner tub through an inlet space between the outer tub and the inner tub; and a warm-air outlet provided in the inner tub opposite the warm-air inlet of the inner tub on the horizontal axis of the inner tub or in the vicinity of the horizontal axis for exhausting the warm air, which enters the inner tub through the warm-air inlet, to the outer tub through an outlet space between the outer tub and the inner tub; and an exhaust-air passage having an opening in the outer tub facing the warm-air outlet, for exhausting warm air used for drying the laundry to the outside of the outer tub;

wherein, the machine for washing, removing liquid from and drying laundry rotates the inner tub about the horizontal axis by detaching the rotation-support member rotating means from the rotation drive means by the switching means and introduces the warm air heated by the heating means into the inner tub and exhausts the warm air from the inner tub substantially along the horizontal axis for drying the laundry in the inner tub from which liquid is removed.

23. A machine for washing, removing liquid from and drying laundry, comprising:

an outer tub for containing liquid;

a liquid supply and drain means for supplying liquid to and draining liquid out of the outer tub;

a rotation-support member rotatably supported about a vertical axis almost parallel with the gravity direction in the outer tub;

an inner tub, having multiple pores in its periphery and being rotatably supported about a horizontal axis orthogonal to the vertical axis by the rotation-support member, for containing the laundry;

a rotation drive means including a motor;

an inner-tub rotating means, which is provided between the rotation drive means and the inner tub, always connecting the rotation drive means with the inner tub, and having a decelerating means for rotating the inner tub at a low speed;

a rotation-support member rotating means for attaching the rotation-support member with the rotation drive means and transmitting a turning force to the rotation-support member;

a switching means, provided at the rotation-support member rotating means, for attaching the rotation-support member rotating means to the rotation drive means and for detaching the rotation-support member rotating means from the rotation drive means; and a heating means for drying the laundry in the inner tub, the heating means comprising:

a warm-air supply passage having an opening in the peripheral wall of the outer tub on the horizontal axis of the inner tub or in the vicinity of the horizontal axis, for introducing the warm air heated by the heating means into the outer tub through the opening;

a warm-air inlet provided in the peripheral wall of the inner tub facing the opening of the outer tub on the horizontal axis of the inner tub or in the vicinity of the horizontal axis, for introducing the warm air, which enters the outer tub through the opening of the warm-air supply passage, into the inner tub through an inlet space between the outer tub and the inner tub; and an exhaust-air passage having an opening in the peripheral wall of the outer tub spaced apart from the warm-air supply passage, for exhausting warm air, used for drying the laundry, out of the inner tub through the multiple pores of the inner tub and the outer tub to the outside of the outer tub;

wherein, the machine for washing, removing liquid from and drying laundry rotates the inner tub about the horizontal axis by detaching the rotation-support member rotating means from the rotation drive means using the switching means, and flows the warm air heated by the heating means through the inner tub substantially along the horizontal axis, for drying the laundry in the inner tub from which liquid is removed.

24. A machine for washing, removing liquid from and drying laundry, comprising:

an outer tub for containing liquid;

a liquid supply and drain means for supplying liquid to and draining liquid out of the outer tub;

a rotation-support member rotatably supported about a vertical axis in the outer tub;

an inner tub, having multiple pores in its periphery and being rotatably supported about a horizontal axis by the rotation-support member, for containing the laundry;

a rotation drive means including a motor;

an inner-tub rotating means, which is provided between the rotation drive means and the inner tub, connecting the rotation drive means with the inner tub; and having a decelerating means for rotating the inner tub at a first speed;

a rotation-support member rotating means for attaching the rotation-support member to the rotation drive means and for transmitting a turning force to the rotation-support member;

a switching means, provided at the rotation-support member rotating means, for attaching the rotation-support member rotating means to the rotation drive means and for detaching the rotation-support member rotating means from the rotation drive means, the switching means being constructed to provide for rotation and drive of only the inner-tub rotating means by the rotation drive means, to prevent rotation of the rotation-support member and to rotate the inner tub about the horizontal axis only at the first speed, when the rotation-support member rotating means is detached from the rotation drive means, and to provide for rotation and drive of the rotation-support member rotating means together with the inner-tub rotating means and rotation of the rotation-support member and the inner tub about the vertical axis in the same direction at a second speed, which is greater than the first speed, and to prevent the rotation of the inner tub about the horizontal axis relative to the rotation-support member, when the rotation-support member rotating means is attached to the rotation drive means by the switching means;

a heating means for drying the laundry in the inner tub, the heating means comprising:

a warm-air supply passage having an opening in the peripheral wall of the outer tub on the horizontal axis of the inner tub or in the vicinity of the horizontal axis, for introducing the warm air heated by the heating means into the outer tub through the opening;

a warm-air inlet provided in the peripheral wall of the inner tub facing the opening of the outer tub on the horizontal axis or in the vicinity of the horizontal axis, for introducing the warm air, which enters the outer tub through the opening of the warm-air supply passage, into the inner tub through a space between the outer tub and the inner tub; and an exhaust-air passage having an opening in the peripheral wall of the outer tub spaced apart from the warm-air supply passage, for exhausting warm air used for drying the laundry out of the inner tub through the outer tub to the outside of the outer tub;

wherein, the machine for washing, removing liquid from and drying laundry:

rotates only the inner tub about the horizontal axis at the first speed for drying the laundry with warm air heated by the heating means and introduced into the inner tub substantially along the horizontal axis by detaching the rotation-support member rotating means from the rotation drive means using the switching means, rotates and drives the rotation-support member rotating means together with the inner tub rotating means to rotate the rotation-support member and the inner tub about the vertical axis in the same direction at the second speed, and to prevent the rotation of the inner tub about the horizontal axis relative to the rotation-support member by attaching the rotation-support member rotating means to the rotation drive means using the switching means, and repeats rotation of the inner tub about the horizontal axis and the vertical axis alternately so as to effectively and uniformly dry the laundry.

25. A machine for washing, removing liquid from and drying laundry, comprising:

an outer tub for containing liquid;

a liquid supply and drain means for supplying liquid to and draining out of the outer tub;

a rotation-support member rotatably supported about a vertical axis in the outer tub;

an inner tub, having multiple pores in its periphery and being rotatably supported about a horizontal axis by the rotation-support member, for containing the laundry;

a rotation drive means including a motor;

an inner-tub rotating means, which is provided between the rotation drive means and the inner tub, connecting the rotation drive means with the inner tub, and having a decelerating means for rotating the inner tub at a first speed;

a rotation-support member rotating means for attaching the rotation-support member to the rotation drive means and for transmitting a turning force to the rotation-support member;

a switching means, provided at the rotation-support member rotating means, for attaching the rotation-support member rotating means to the rotation drive means and for detaching the rotation-support member rotating means from the rotation drive means, the switching means being constructed to provide for rotation and drive of only the inner-tub rotating means by the rotation drive means, to prevent the rotation of the rotation-support member and to rotate the inner tub about the horizontal axis only at the first speed, when the rotation-support member rotating means is detached from the rotation drive means, and to provide for rotation and drive of the rotation-support member rotating means together with the inner-tub rotating means and rotation of the rotation-support member and the inner tub about the vertical axis in the same direction at a second speed, which is greater than the first speed, and to prevent the rotation of the inner tub about the horizontal axis relative to the rotation-support member, when the rotation-support member rotating means is attached to the rotation drive means by the switching means; and a heating means for drying the laundry in the inner tub, the heating means comprising:

a warm-air supply passage having an opening in the peripheral wall of the outer tub on the horizontal axis of the inner tub or in the vicinity of the horizontal axis, for introducing the warm air heated by the heating means into the outer tub through the opening;

a warm-air inlet in the form of a hollow rotating shaft provided at the periphery of the inner tub facing the opening of the outer tub on the horizontal axis of the inner tub, and supported around the horizontal axis by the rotation-support member, for introducing the warm air, which enters the outer tub through the opening of the warm-air supply passage, into the inner tub through an inlet space between the outer tub and the inner tub; and a warm-air outlet in the form of a hollow rotating shaft provided at the periphery of the inner tub diametrically opposite the warm air inlet of the inner tub on the horizontal axis of the inner tub, and supported around the support member, for exhausting the warm air, which enters the inner tub through the warm-air inlet, to the outer tub through an outlet space between the outer tub and the inner tub; and an exhaust-air passage having an opening in the outer tub facing the warm-air outlet, for exhausting warm air used for drying the laundry to the outside of the outer tub;

wherein, the machine for washing, removing liquid from and drying laundry;

rotates the inner tub about the horizontal axis at the first speed by detaching the rotation support member rotating means from the rotation drive means by the switching means and introduces the warm air heated by the heating means into the inner tub and exhausts the warm air from the inner tub substantially along the horizontal axis for drying the laundry in the inner tub from which liquid is removed, rotates the rotation-support member together with the inner tub at 180 degrees about the vertical axis by attaching the rotation-support member rotating means to the rotation drive means by the switching means so as to locate the warm-air outlet facing the opening in the peripheral wall of the outer tub of the warm-air supply passage, rotates the inner tub about the horizontal axis at the first speed by detaching the rotation-support member rotating means from the rotation drive means by the switching means and introduces the warm air heated by the heating means into the inner tub and exhausts the warm air from the inner tub substantially along the horizontal axis for drying the laundry in the inner tub from which liquid is removed, and repeats rotation of the inner tub about the horizontal axis and the vertical axis alternately so as to effectively and uniformly dry the laundry.

* * * * *